US006426725B2

(12) United States Patent
Hiroshima et al.

(10) Patent No.: US 6,426,725 B2
(45) Date of Patent: Jul. 30, 2002

(54) ANTENNA DEVICE AND COMMUNICATION DEVICE

(75) Inventors: Motoharu Hiroshima; Hideyuki Kato, both of Ishikawa-ken (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 09/761,084

(22) Filed: Jan. 16, 2001

(30) Foreign Application Priority Data

Jan. 20, 2000 (JP) ..... 2000-011160
Nov. 9, 2000 (JP) ..... 2000-342541

(51) Int. Cl.[7] ..... H01P 1/202
(52) U.S. Cl. ..... 343/741; 333/203; 333/206; 333/134; 343/700 MS
(58) Field of Search ..... 343/741, 700 MS, 343/702; 333/204, 126, 203, 206, 202, 207

(56) References Cited

U.S. PATENT DOCUMENTS 5,130,683 A * 7/1992 Agahi-Kesheh et al. .... 333/203
5,361,050 A * 11/1994 Einbinder ..... 333/204
5,684,492 A * 11/1997 Kagoshima ..... 343/700 MS
5,864,265 A * 1/1999 Ballance et al. ..... 333/206

* cited by examiner

*Primary Examiner*—Tho Phan
*Assistant Examiner*—James Clinger
(74) *Attorney, Agent, or Firm*—Ostrolenk, Faber, Gerb & Soffen, LLP

(57) ABSTRACT

A communication device in which the problem caused by separately providing an antenna and a filter directly connected thereto, and the problem caused by separately providing a balanced-to-unbalanced transformer, have been solved. A dielectric filter having a both-end opened λ/2 resonator is constructed by providing inner-conductor forming holes in a dielectric block. An antenna is constructed by forming a radiation electrode and terminal electrodes on a dielectric block. By bonding the antenna and dielectric filter, an antenna device is achieved which has a balanced feed antenna and which performs the input-output of unbalanced signals.

86 Claims, 14 Drawing Sheets

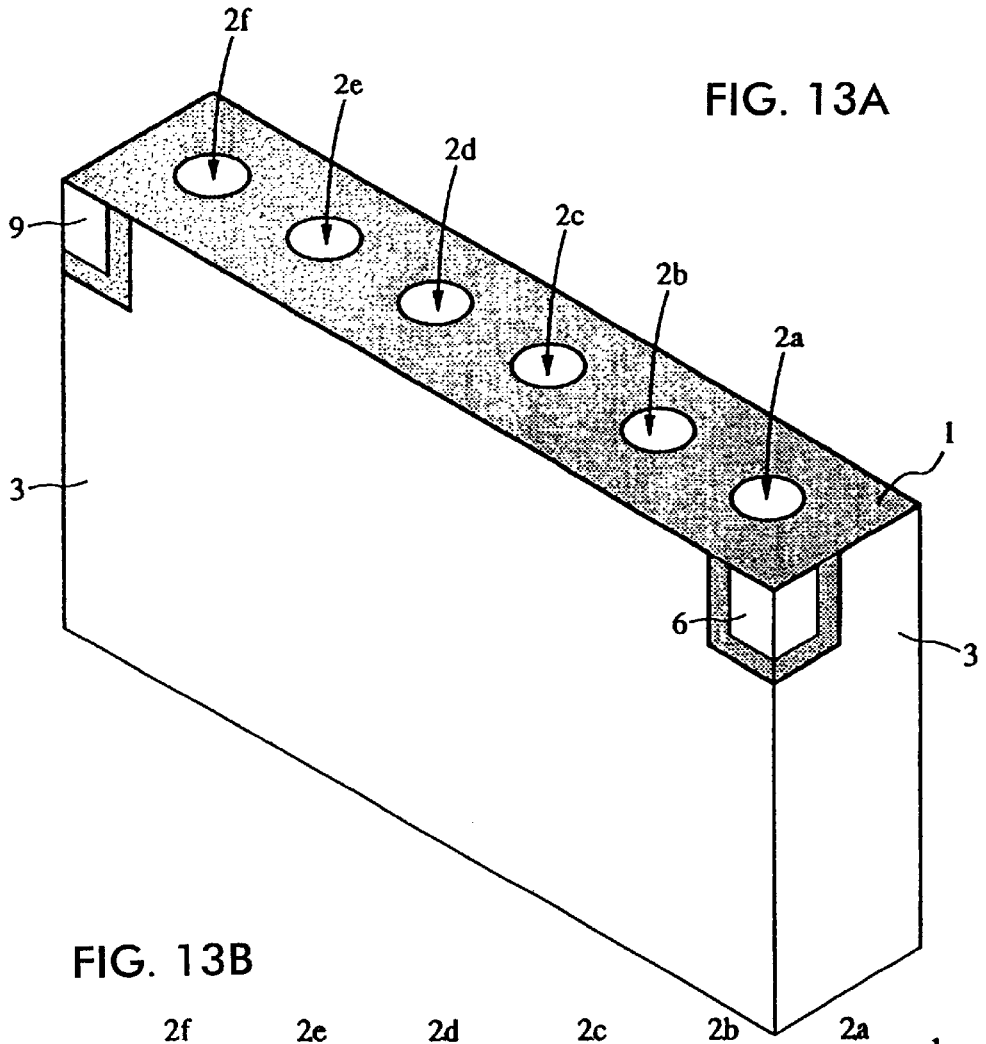
FIG. 13A
FIG. 13B
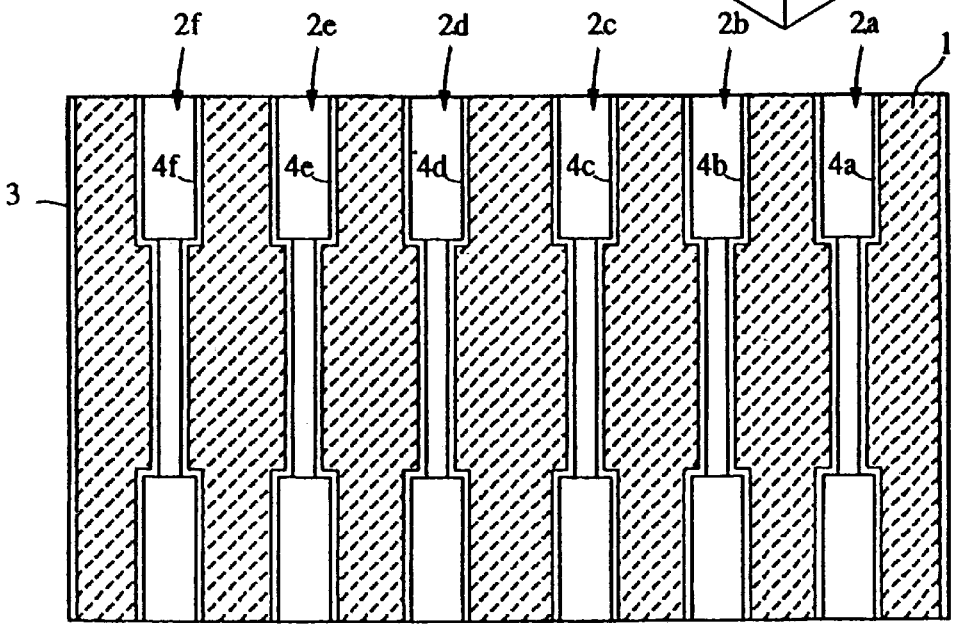

ANTENNA DEVICE AND COMMUNICATION DEVICE

BACKGROUND OF THE INVENTION

1. Field of the Invention

The present invention relates to an antenna device having a balanced feed antenna and a communication device using the same.

2. Description of the Related Art

Among recent mobile communication systems, particularly among TDMA communication devices (portable telephone sets) based on the TDD (Time Division Duplex) system, communication devices each having a constitution in which an antenna is directly connected to the filter in the high-frequency circuit thereof, are increasing in number.

On the other hand, as antennae provided on the terminal equipment of mobile communication systems, for example, loop antennae or half-wave dipole antennae, which use a half-wave element, are hardly subjected to external effects. They provide characteristics more stable than quarter wave antenna.

However, the loop antenna or the half-wave dipole antenna is a balanced feed antenna, from which the output becomes balanced, and hence requires a balanced-to-unbalanced transformer (balun) for establishing the connection with the high-frequency circuit which processes unbalanced signals.

In such a structure using the balanced-to-unbalanced transformer, problems occur in that not only the number of components to be used is increased and the footprint thereof on a substrate is enlarged, but also a conversion loss is caused.

SUMMARY OF THE INVENTION

Accordingly, it is an object of the present invention to provide an antenna device and a communication device in which the problem caused by separately providing the above-described balun has been solved.

It is another object of the present invention to provide an antenna device and a communication device which allows this antenna device and communication device to be reduced in size in its entirety by reducing the space required for the above-described antenna and the filter portion directly connected thereto.

In accordance with a first aspect of the present invention, there is provided an antenna device comprising a first resonator formed by opening both ends of a λ/2 TEM resonator; a second resonator formed by opening both ends of two λ/4 TEM resonators which are connected together, or formed by opening both ends of a λ/2 TEM resonator; a filter in which the first and second resonators are coupled together, in which a portion connected to the vicinity of one of the open ends of the first resonator is used as an unbalanced input-output portion, and in which a portion connected to the second resonator is used as a balanced input-output portion; and a balanced feed antenna coupled with the balanced input-output portion.

In accordance with a second aspect of the present invention, there is provided an antenna device comprising a first resonator formed by short-circuiting both ends of two λ/4 TEM resonators which are connected together, or formed by short-circuiting both ends of a λ/2 TEM resonator; a second resonator formed by opening both ends of two λ/4 TEM resonators which are connected together, or formed by opening both ends of a λ/2 TEM resonator; a filter in which the first and second resonators are coupled together, in which a portion connected to the vicinity of the equivalent open end of the first resonator is used as an unbalanced input-output portion, and in which a portion connected to the second resonator is used as a balanced input-output portion; and a balanced feed antenna coupled with the balanced input-output portion.

In accordance with a third aspect of the present invention, there is provided an antenna device comprising a first resonator formed by short-circuiting one end of λ/4 TEM resonator; a second resonator formed by opening both ends of two ¼ TEM resonators which are connected together, or formed by opening both ends of a λ/2 TEM resonator; a filter in which the first and second resonators are coupled together, in which a portion connected to the vicinity of the open end of the first resonator is used as an unbalanced input-output portion, and in which a portion connected to the second resonator is used as a balanced input-output portion; and a balanced feed antenna coupled with the balanced input-output portion.

In accordance with a fourth aspect of the present invention, there is provided an antenna device comprising a first resonator formed by opening both ends of two λ/4 TEM resonators which are connected together, or formed by opening both ends of a λ/2 TEM resonator; a second resonator formed by opening both ends of two λ/4 TEM resonators which are connected together, or formed by opening both ends of a λ/2 TEM resonator; a filter in which the first and second resonators are coupled together, in which a portion connected to the vicinities of the open ends of the first resonator is used as a first balanced input-output portion, and in which a portion connected to the vicinities of the open ends of the second resonator is used as a second balanced input-output portion; and a balanced feed antenna coupled with the first or second balanced input-output portion.

By these structures, using the unbalanced input-output portion and balanced input-output portion, a balanced-to-unbalanced transformation is performed, a predetermined frequency band is passed and attenuated, and a balanced feed to the antenna is performed. Specifically, when the present antenna device is used as a reception antenna device, a balanced signal is output as an unbalanced signal from the antenna through the filter. Conversely, when the antenna device is used as a transmission antenna device, an unbalanced signal is input, fed in a balanced manner to the antenna through the filter, and an electromagnetic wave is emitted.

This eliminates the need for a balanced-to-unbalanced transformer dedicated to the present antenna device. Furthermore, since the filter and the antenna are integrated, the number of components to be used is reduced, and the footprint on the substrate in a communication device is decreased.

Preferably, each of the above-described λ/2 TEM resonator and λ/4 TEM resonator comprises a microstrip line and a strip line, or comprises a dielectric coaxial resonator formed by providing a conductor film on the dielectric block.

The present invention, in a fifth aspect, provides an antenna device comprising a filter having a resonator which resonates in modes other than the TEM mode and which is constructed by forming a conductor film on the outer surface of a dielectric block, and having a balanced input-output portion coupled with the resonator; and a balanced feed antenna coupled with the balanced input-output portion.

These features allow this antenna device to be used even in a high-frequency band such that the filter is difficult to form in a TEM mode resonator.

Also, in the present invention, preferably an antenna device formed integrally with the dielectric duplexer is obtained by making a dielectric duplexer of the above-described dielectric filter.

Also, in the antenna device in accordance with the present invention, preferably the dielectric filter and the antenna are integrated by connecting the balanced input-output portion of the dielectric filter and the balanced feed antenna on the line of a substrate. For example, when mounting this antenna device on the circuit board of a communication device, the terminal provided on the substrate of the antenna device is made conductive to the terminal provided on the substrate of the communication device.

Furthermore, in the antenna device in accordance with present invention, preferably the balanced input-output portion of the dielectric filter and the balanced feed antenna are directly connected together by bonding the dielectric filter and the antenna. This structure allows the dielectric filter and the antenna to be separately produced, and enables the dielectric filter and the antenna to be integrated without the need for using other components such as a substrate.

Moreover, in the antenna device in accordance with present invention, preferably the balanced feed antenna is constructed on the dielectric block in which a balanced feed terminal is formed on the outer surface thereof. This facilitates mounting the antenna on the substrate, or facilitates bonding the antenna to the dielectric filter provided on the dielectric block.

Besides, in the antenna device in accordance with the present invention, preferably the balanced feed antenna and the dielectric filter are formed integrally with the dielectric block. This reduces the number of components to be used, and significantly decreases the footprint of the communication device on the substrate.

Also, in the antenna device in accordance with present invention, preferably the effective permittivity of the dielectric block is made different between the balanced feed antenna portion and the dielectric filter portion on the dielectric block, with which the balanced feed antenna and the dielectric filter are formed integrally. This allows the each of the antenna and the dielectric filter to be formed with respect to the dielectric block which has the respective optimum dielectric constants in the antenna portion and the dielectric filter portion thereof, and allows an high-efficiency antenna and a dielectric filter applied to a predetermined frequency band to be formed within a limited space.

The communication device in accordance with the present invention is constructed using the above-described antenna device. This allows a compact and lightweight communication device having a superior stability to be achieved.

The above and other objects, features, and advantages of the present invention will be clear from the following detailed description of the preferred embodiments of the invention in conjunction with the accompanying drawings.

BRIEF DESCRIPTION OF THE DRAWING(S)

FIGS. 1A and 1B are diagrams showing an antenna device in accordance with a first embodiment, wherein FIG. 1A is a plan view and FIG. 1B is an equivalent circuit view;

FIGS. 2A and 2B are diagrams showing an antenna device in accordance with a second embodiment, wherein FIG. 2A is a plan view and FIG. 2B is an equivalent circuit view;

FIGS. 7A and 7B are diagrams showing the construction of an antenna device in accordance with a seventh embodiment, wherein FIG. 7A is a perspective view of the main section thereof and FIG. 7B is a vertical sectional view thereof;

FIGS. 11A and 11B are diagrams illustrating an antenna device in accordance with an eleventh embodiment, wherein FIG. 11A is a perspective view showing the appearance thereof and FIG. 11B is a vertical sectional view thereof;

FIGS. 13A and 13B are perspective view illustrating the construction of the dielectric duplexer portion in an antenna device in accordance with a thirteenth embodiment, wherein FIG. 13A is a perspective view showing the appearance thereof and FIG. 13B is a vertical sectional view thereof;

Figure 14A:
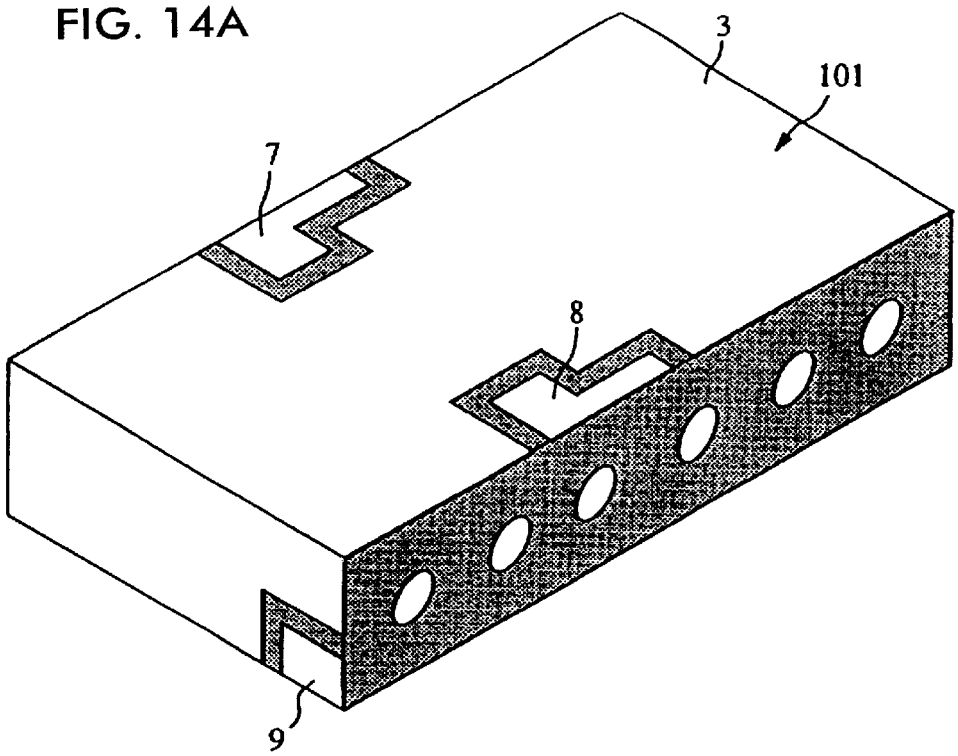
Figure 14B:
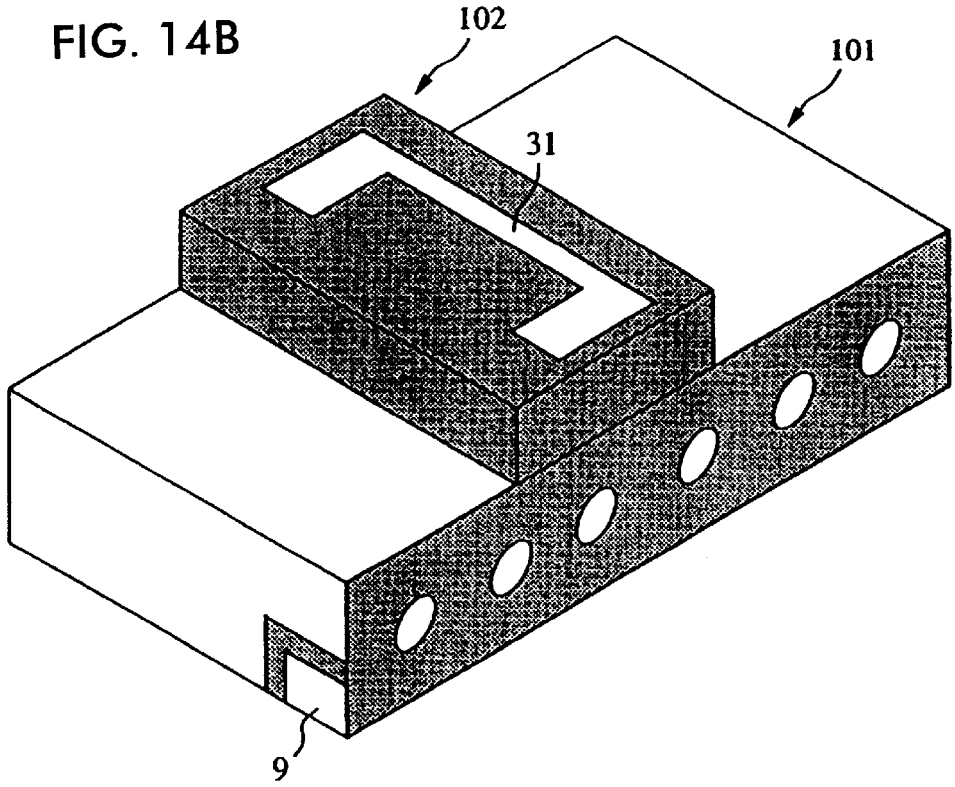
Figure 15A:
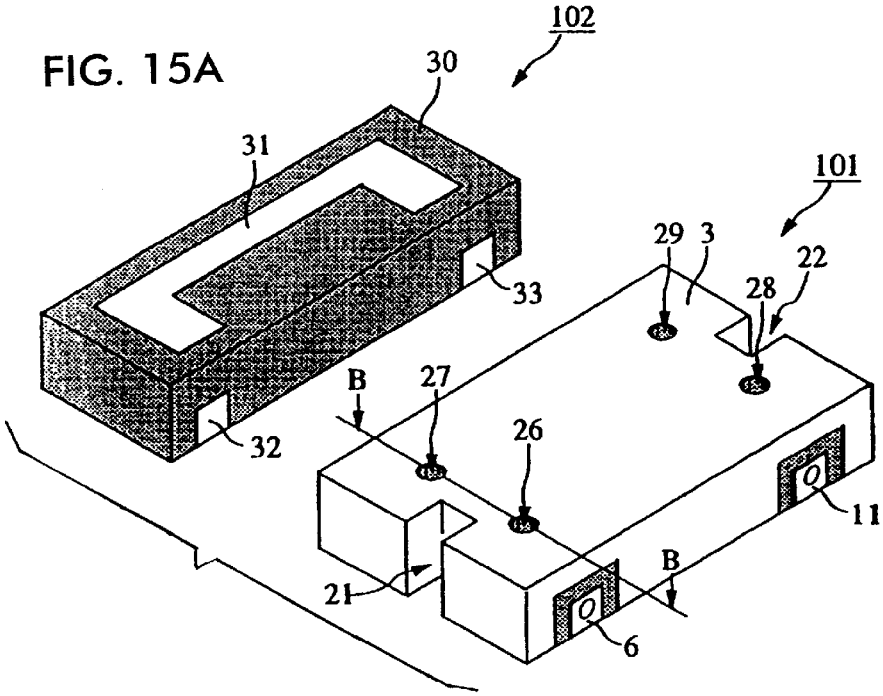
Figure 15B:
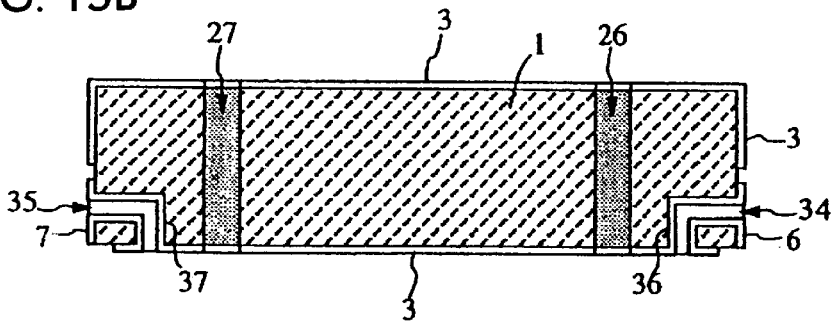
Figure 15C:
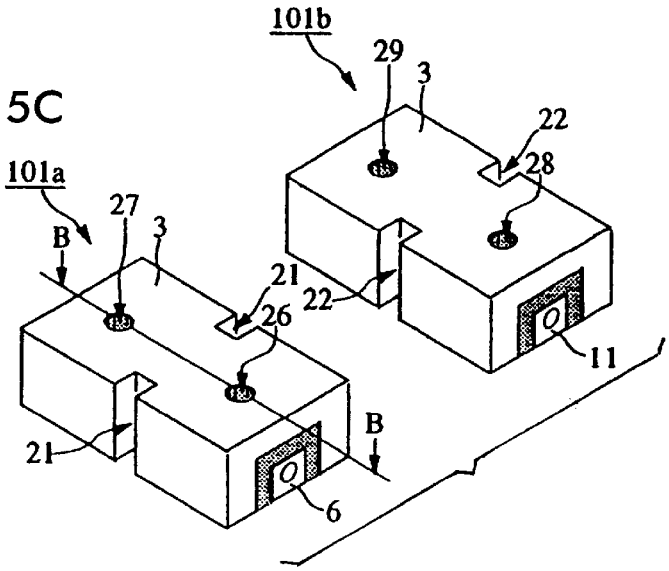
Figure 16:
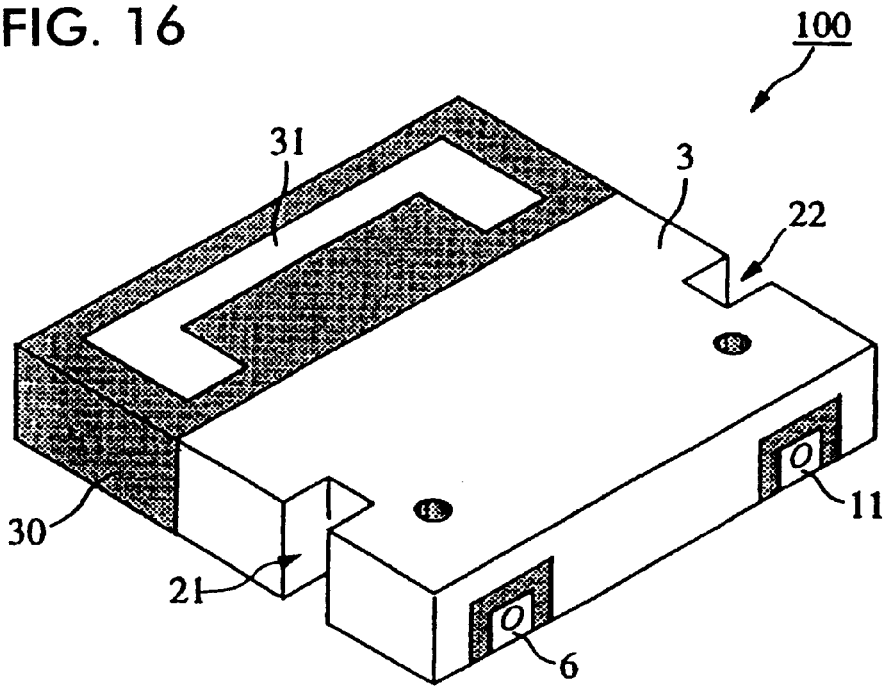
Figure 17:
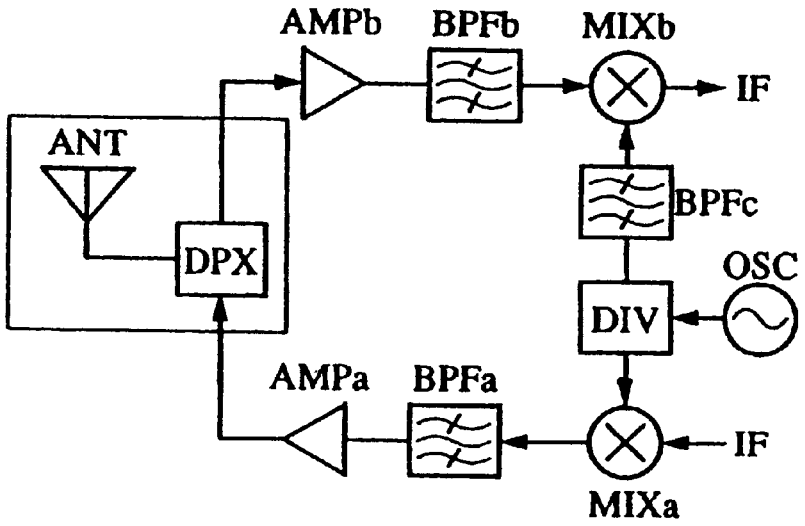

FIGS. 14A and 14B are diagrams illustrating the appearance of the antenna device of the thirteen embodiment, wherein FIG. 14A is a perspective view illustrating other outer surfaces of the duplexer portion shown in FIG. 13A, and FIG. 14B is a perspective view illustrating the state wherein the antenna has been bonded to the top surface of the dielectric block, in comparison with the state shown in FIG. 14A;

FIGS. 15A through 15C are diagrams illustrating the constructions of the dielectric filter and the antenna used in an antenna device in accordance with a fourteenth embodiment, wherein FIG. 15A is a perspective view thereof, FIG. 15B is a vertical sectional view taken along the line B—B in the FIG. 15A, and FIG. 15C is a diagram for explaining the operation of the dielectric filter;

FIG. 16 is a perspective view illustrating the appearance of the antenna device in accordance with the fourteen embodiment; and FIG. 17 is a block diagram illustrating the construction of a communication device in accordance with a fifteen embodiment.

DETAILED DESCRIPTION OF EMBODIMENTS OF THE INVENTION

The construction of the first embodiment of the present invention will now be described with reference to FIGS. 1A and 1B.

Figure 1A:
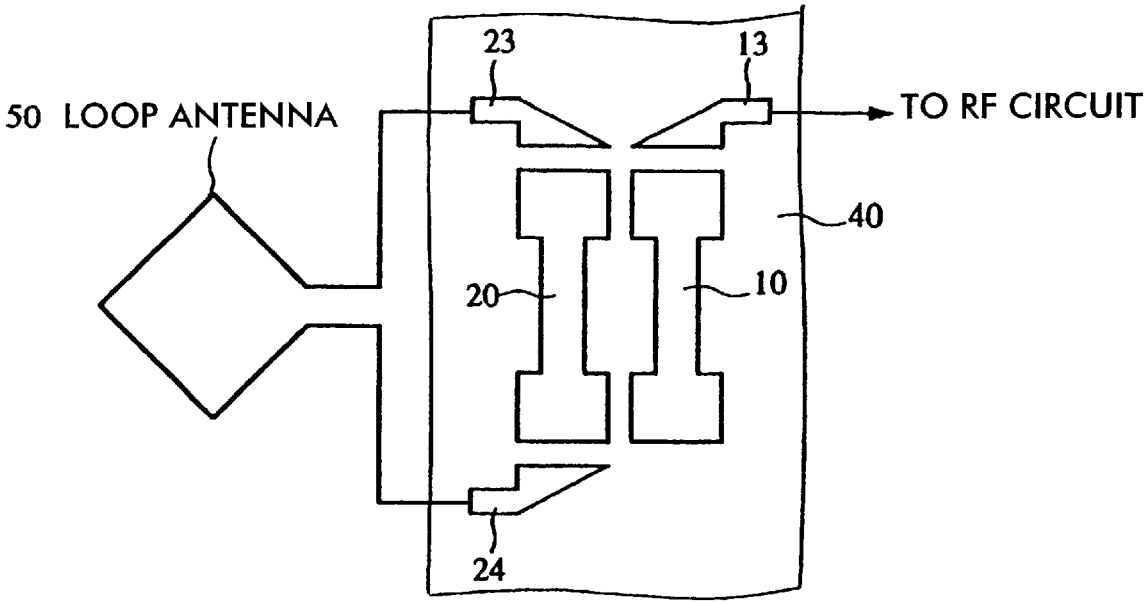

FIG. 1A is a plan view of the antenna device. Herein, reference numerals 10 and 20 each designate stripline electrodes, which are disposed on the top surface of a dielectric substrate 40 adjacent to each other. A ground electrode is formed over substantially the entire bottom surface of the dielectric substrate 40. The dielectric substrate 40, each of the stripline electrodes 10 and 20, and the ground electrode constitute a microstrip line resonator. By forming each of the striplines 10 and 20 narrow in the central portion and wide at both end sides (open end sides) thereof, the electrostatic capacitance between the stripline electrodes on the open end sides is made larger than that between the equivalent short-circuited end sides (central portions) thereof. Furthermore, by making a difference between the resonance frequencies of an odd mode and an even mode, the resonators are capacitively coupled together. Reference numerals 13, 23, and 24 each designate terminal electrodes. Between one of the open ends of the stripline electrode 10 and the terminal electrode 13, an electrostatic capacitance is formed. Also, between the open ends of the stripline electrode 20 and the respective terminal electrodes 23 and 24, electrostatic capacitances are each formed. A loop antenna 50 is connected to the terminal electrodes 23 and 24.

Figure 1B:
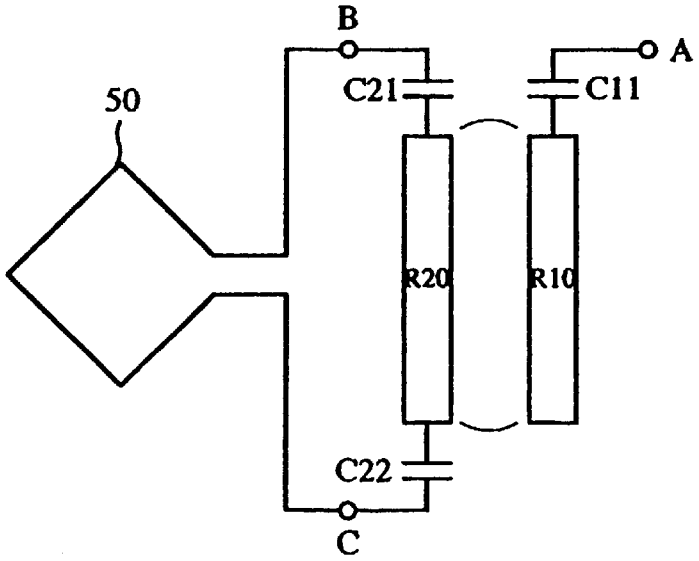

FIG. 1B is an equivalent circuit view showing the above-described antenna device. Herein, reference characters R10 and R20 designate both-end opened λ/2 resonators formed of the respective stripline electrodes 10 and 20 shown in FIG. 1A. Reference character C11 designates an electrostatic capacitance generated between the stripline electrode 10 and the terminal electrode 13, and reference characters C21 and C22 each designate electrostatic capacitances generated between the stripline electrode 20 and the terminal electrodes 23 and 24, respectively.

When the above-described antenna device is provided at the antenna portion of a communication device, the antenna device is directly connected to the high-frequency circuit treating balanced signals without the need for using a balun i.e., a balanced-to-unbalanced transformer.

In FIG. 1B, when a signal is input from a terminal A, the potentials of both ends of the λ/2 resonator R10 are reversed in polarity by coupling with the signal, and the signal couples with the λ/2 resonator R20 while maintaining these potentials.

As a result, from the output terminals B and C of each of the resonators R10 and R20, outputs are obtained which have filter characteristics and which are different by 180 degree in phase from each other. That is, A works as an unbalanced input terminal, B and C work as balanced output terminals, and the band-pass filter characteristics created by the resonators R10 and R20 are provided between these input and output terminals. As described above, since the resonators R10 and R20 are capacitively coupled together, characteristics having an attenuation pole on the lower frequency side of the pass band are provided. A balanced feed to the loop antenna 50 is thus performed, and an electromagnetic wave is transmitted.

Conversely, when the loop antenna 50 is used as a transmission antenna, a balanced signal output from the loop antenna 50 is supplied between the terminals B and C, the resonator R20 resonates as a λ/2 resonator, and an unbalanced signal is output from the terminal A of the resonator R10 coupled with this resonator R20. That is, B and C work as balanced input terminals, A works as an unbalanced output terminal, and band-pass filter characteristics created by the resonators R20 and R10 are provided between these input and output terminals.

Next, the construction of the second embodiment of the present invention will be described with reference to FIGS. 2A and 2B.

Figure 2A:
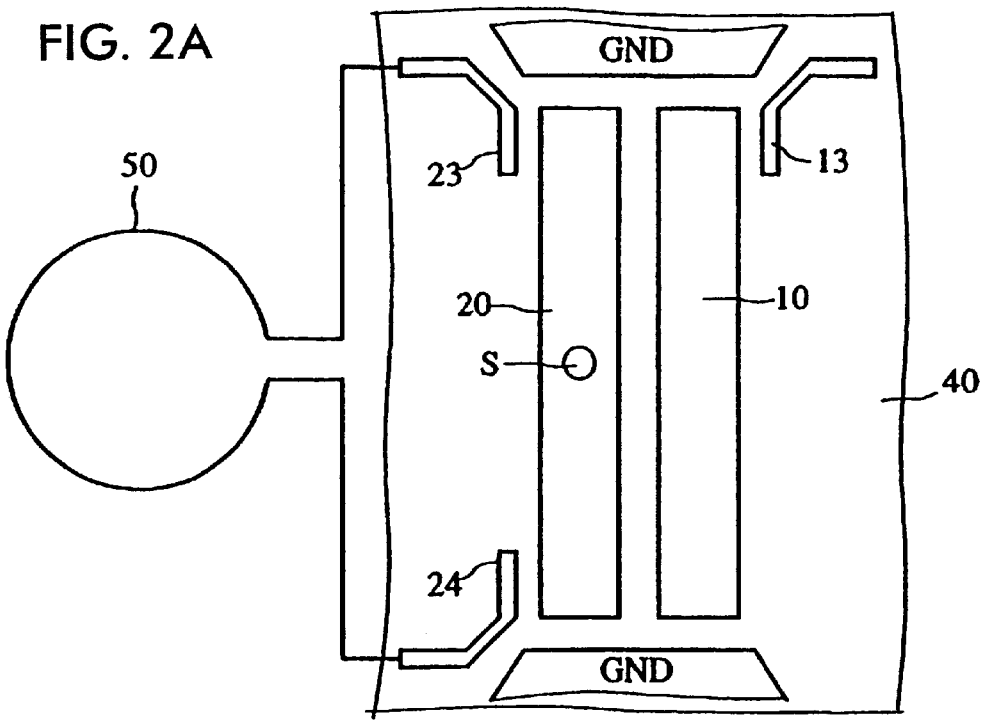

FIG. 2A is a plan view of the antenna device. Herein, reference numerals 10 and 20 each designate stripline electrodes, which are disposed on the top surface of a dielectric substrate 40 adjacent to each other. A ground electrode is formed over substantially the entire bottom surface of the dielectric substrate 40. The dielectric substrate 40, each of the stripline electrodes 10 and 20, and the ground electrode constitute a microstrip line resonator. GNDs are ground electrodes formed on the top surface of the dielectric substrate 40. Reference character S designates a through hole, via which the central portion of the stripline electrode 20 electrically connects to the ground electrode on the bottom surface of the dielectric substrate 40. Reference numerals 13, 23, and 24 each designate terminal electrodes. Between one of the open ends of the stripline electrode 10 and the terminal electrode 13, an electrostatic capacitance is generated. Also, between the vicinities of both open ends of the stripline electrode 20 and the terminal electrodes 23 and 24, electrostatic capacitances are generated, respectively. A loop antenna 50 is connected to the terminal electrodes 23 and 24.

Figure 2B:
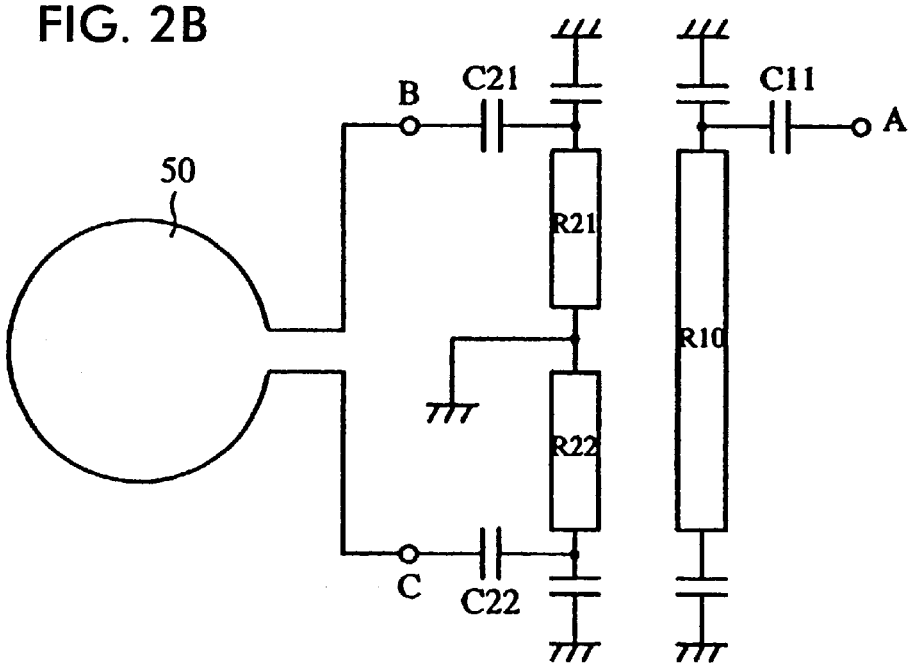

FIG. 2B is an equivalent circuit view showing the above-described antenna device. As illustrated in FIG. 2B, in this antenna device, the first resonator R10 and the second resonator R21 and R22 are each inductively coupled by the electrostatic capacitances between both open ends of the resonator R10 and ground, and those between the open end of each of the resonators R21 and R22 and the ground.

In FIG. 2B, when a signal is input from a terminal A, the potentials of both ends of the λ/2 resonator R10 are reversed in polarity by coupling with the signal, and the signal couples with the two connected λ/4 resonators R21 and R22 while maintaining these potentials. As a result, from the output terminals B and C of each of the resonator 10 and the connected resonators R21 and R22, outputs are obtained which have filter characteristics and which are different by 180 degree in phase from each other. That is, A works as an unbalanced input terminal, B and C work as balanced output terminals, and band-pass filter characteristics created by the resonators R10, R21, and R22 are provided between the input and the output. As described above, since the resonator RIO and each of the two connected resonators R21 and R22 are inductively coupled together, characteristics having an attenuation pole on the higher frequency side of the pass band are provided between these input and output terminals. A balanced feed to the loop antenna 50 is thus performed, and an electromagnetic wave is transmitted.

Conversely, when the loop antenna 50 is used as a transmission antenna, a balanced signal output from the loop antenna 50 is supplied between the terminals B and C, each of the two connected resonators R21 and R22 resonates as a λ/4 resonator, and an unbalanced signal is output from the terminal A of the resonator R10 coupled with the two connected resonators R21 and R22. That is, B and C work as balanced input terminals, A works as an unbalanced output terminal, and bandpass filter characteristics created by the resonators R21, R22 and R10 are provided between these input and output terminals.

Next, examples of the construction of the antenna devices will be illustrated as equivalent circuit views in FIGS. 3 through 6.

Figure 3A:
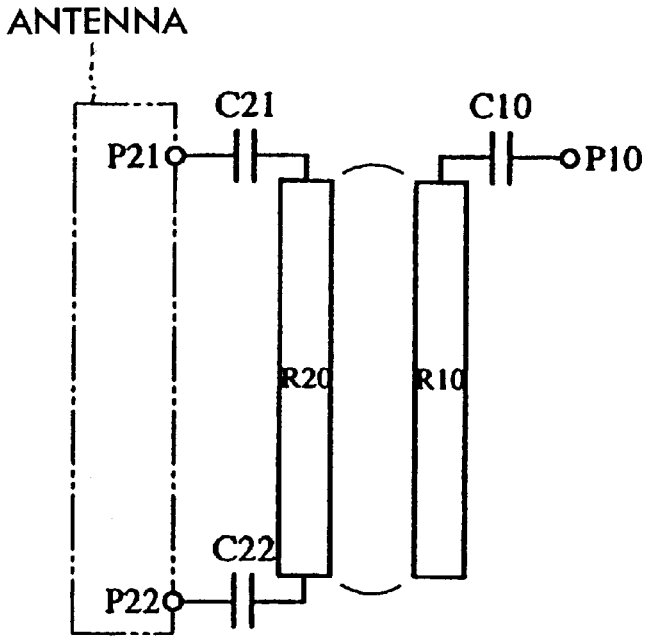
FIGS. 3A and 3B are equivalent circuit views showing an antenna device in accordance with a third embodiment.
Figure 3B:
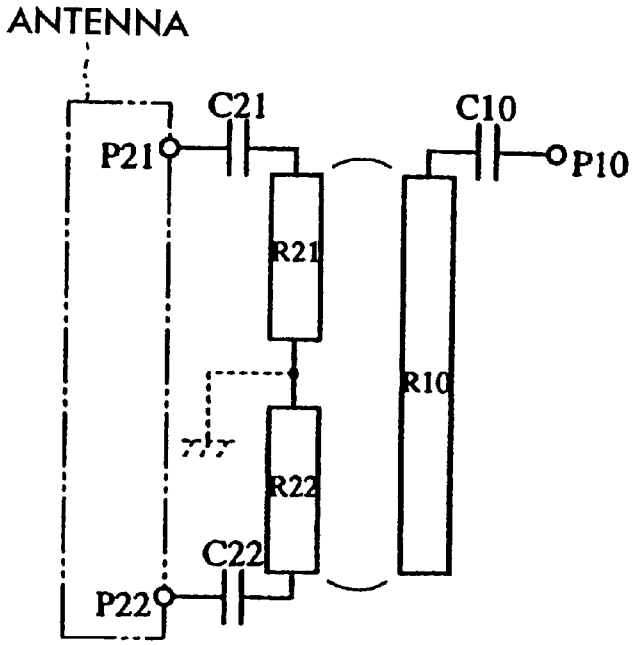

FIGS. 3A and 3B are construction examples corresponding to the first aspect of the present invention. Each of these examples has an unbalanced terminal P10 and balanced terminals P21 and P22, to which a balanced feed antenna is connected.

In FIG. 3A, reference character R10 designates a both-end opened λ/2 resonator, which works as a first resonator. Reference character R20 also designates a both-end opened λ/2 resonator, which works as a second resonator. Reference character C10 designates an electrostatic capacitance generated between the unbalanced terminal P10 and the first resonator, and reference characters C21 and C22 each designates electrostatic capacitances generated between the second resonator and the balanced feed antenna.

When the antenna is used as a transmission antenna, once a signal is input from the unbalanced terminal P10, the potentials of both ends of the λ/2 resonator R10 are reversed in polarity by coupling with the signal, and the signal couples with λ/2 resonator R20 while maintaining these potentials. As a result, from the balanced terminals P21 and P22, outputs are obtained which have filter characteristics and which are different by 180 degree in phase from each other. A balanced feed to the loop antenna 50 is thus performed, and an electromagnetic wave is transmitted.

Conversely, when the antenna is used as a reception antenna, a balanced signal output from the antenna is supplied between the terminals P21 and P22, the resonator 20 resonates as a λ/2 resonator, and an unbalanced signal is output from the terminal P10 of the resonator R10 coupled with this resonator R20.

In FIG. 3B, reference character RIO designates a both-end opened λ/2 resonator, which works as a first resonator. Reference characters R21 and R22 each denote λ/4 resonators wherein one-side ends thereof are each opened, wherein the other ends thereof are connected with each other (i.e., made to communicate with each other), and wherein this connection point is made an equivalent short-circuited end or a substantially short-circuited end. These two connected λ/4 resonators work as a second resonator. As described above, the connection point between the resonators R21 and 22 has an equivalent ground potential, and hence does not necessarily require to be actually grounded.

Here, reference character C10 designates an electrostatic capacitance generated between the unbalanced terminal P10 and the first resonator, and reference characters C21 and C22 each designates electrostatic capacitances generated between the second resonator and the balanced feed antenna.

When the antenna is used as a transmission antenna, once a signal is input from the unbalanced terminal P10, the potentials of both ends of the λ/2 resonator R10 are reversed in polarity by coupling with the signal, and the signal couples with the two connected λ/4 resonators R21 and R22 while maintaining these potentials. As a result, from the balanced terminals P21 and P22, outputs are obtained which have filter characteristics and which are different by 180 degree in the phase from each other. A balanced feed to the loop antenna 50 is thus performed, and an electromagnetic wave is transmitted.

Conversely, when the antenna is used as a reception antenna, a balanced signal output from the antenna is supplied between the terminals P21 and P22, each of the two connected resonators R21 and R22 resonate as a λ/4 resonator, and an unbalanced signal is output from the terminal P10 of the resonator R10 coupled with these resonators R21 and R22.

FIGS. 4A through 4D are construction examples corresponding to the second aspect of the present invention. These examples differ from the examples shown in FIGS. 3A and 3B in that each of the first resonators in these examples is short-circuited at both ends thereof. The central portion of each of the first resonators, therefore, forms an equivalent open end. In these examples, each of the equivalent open ends is used as an unbalanced input-output portion.

Figure 4A:
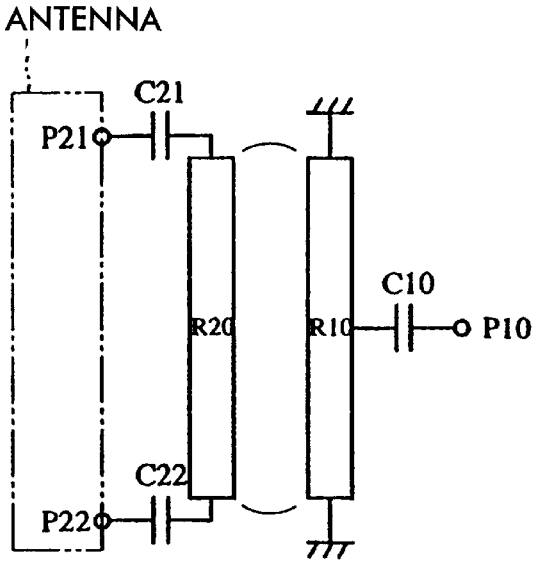
FIGS. 4A through 4D are equivalent circuit views showing an antenna device in accordance with a fourth embodiment.

In FIG. 4A, reference character R10 denotes a both-end short-circuited λ/2 resonator, which works as a first resonator. Reference character R20 denotes a both-end opened λ/2 resonator, which also works as a λ/2 resonator. Reference character C10 denotes an electrostatic capacitance generated between the unbalanced terminal P10 and the first resonator, and reference characters C21 and C22 each denote electrostatic capacitances generated between the second resonator and the balanced feed antenna.

When the antenna is used as a transmission antenna, once a signal is input from the unbalanced terminal P10, the resonator R10 resonates as a λ/2 resonator by coupling with the signal, and the resonator R20 coupled with this resonator R10 also resonates as a λ/2 resonator. As a result, from the balanced terminals P21 and P22, outputs are obtained which have filter characteristics and which are different by 180 degree in phase from each other. A balanced feed to the antenna is thus performed, and an electromagnetic wave is transmitted.

Conversely, when the antenna is used as a reception antenna, a balanced signal output from the antenna is supplied between the terminals P21 and P22, the resonator R20 resonates as a λ/2 resonator, and an unbalanced signal is output from the terminal P10 of the resonator R10 coupled with this resonator R20.

Figure 4B:
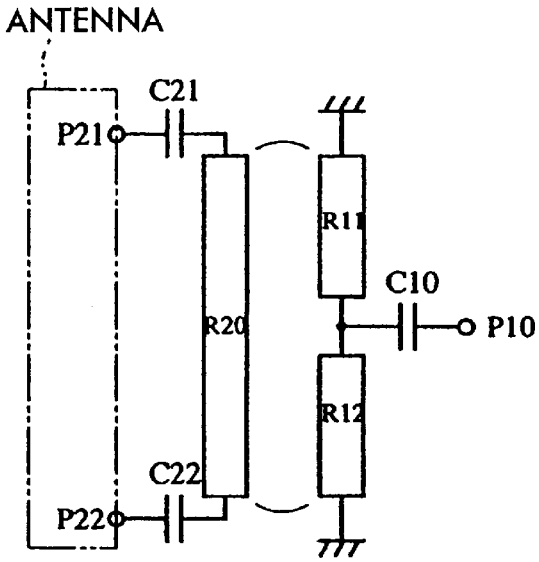

In FIG. 4B, reference characters R11 and R12 each denote λ/4 resonators wherein one-side ends thereof are short-circuited, and wherein the other ends thereof are connected with each other. These two connected resonators R11 and R12 work as a first resonator. Reference characters R20 denotes a both-end opened λ/2 resonator, which works as a second resonator. Reference character C10 denotes an electrostatic capacitance generated between the unbalanced terminal P10 and the first resonator, and reference characters C21 and C22 each denotes electrostatic capacitances generated between the second resonator and the balanced feed antenna.

When the antenna is used as a transmission antenna, once a signal is input from the unbalanced terminal P10, each of the resonators R11 and R12 resonates as a λ/4 resonator by coupling with the signal, and the resonator R20 coupled with these resonators R11 and R12 resonates as a λ/2 resonator. As a result, from the balanced terminals P21 and P22, outputs are obtained which have filter characteristics and which are different by 180 degree in the phase from each other. A balanced feed to the antenna is thus performed, and an electromagnetic wave is transmitted.

Conversely, when the antenna is used as a reception antenna, a balanced signal output from the antenna is supplied between the terminals P21 and P22, the resonator R20 resonates as a λ/2 resonator, and an unbalanced signal is output from the terminal P10 of the resonators R11 and R12 coupled with this resonator R20.

Figure 4C:
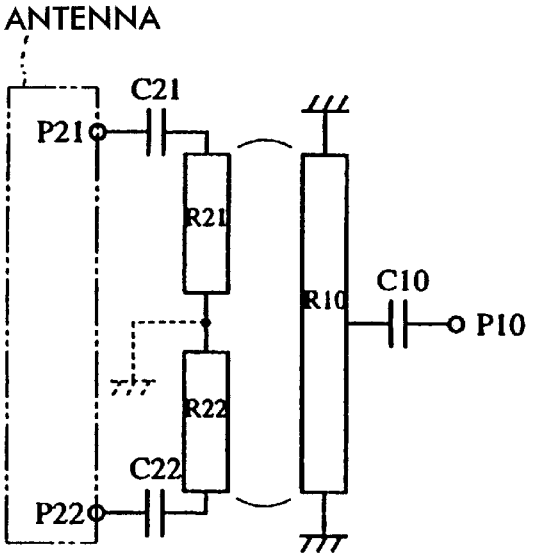

In FIG. 4C, reference character R10 denotes a both-end short-circuited λ/2 resonator, which works as a first resonator. Reference characters R21 and R22 each denote λ/4 resonators wherein one-side ends thereof are each opened, wherein the other ends thereof are connected with each other. These connected resonators R21 and 22 work as a second resonator. The connection point between the resonators R21 and R22 has an equivalent ground potential, and hence does not necessarily require to be actually grounded.

Reference character C10 denotes an electrostatic capacitance generated between the unbalanced terminal P10 and the first resonator, and reference characters C21 and C22 each denotes electrostatic capacitances generated between the second resonator and the balanced feed antenna.

When the antenna is used as a transmission antenna, once a signal is input from the unbalanced terminal P10, the resonator R10 resonates as a λ/2 resonator by coupling with the signal, and each of the resonators R21 and R22 coupled with this resonator R10 resonates as a λ/4 resonator. As a result, from the balanced terminals P21 and P22, outputs are obtained which have filter characteristics and which are different by 180 degrees in the phase from each other. A balanced feed to the antenna is thus performed, and an electromagnetic wave is transmitted.

Conversely, when the antenna is used as a reception antenna, a balanced signal output from the antenna is supplied between the terminals P21 and P22, each of the resonators R21 and R22 resonates as a λ/4 resonator, and an unbalanced signal is output from the terminal P10 of the resonator R10 coupled with these resonators R21 and R22.

Figure 4D:
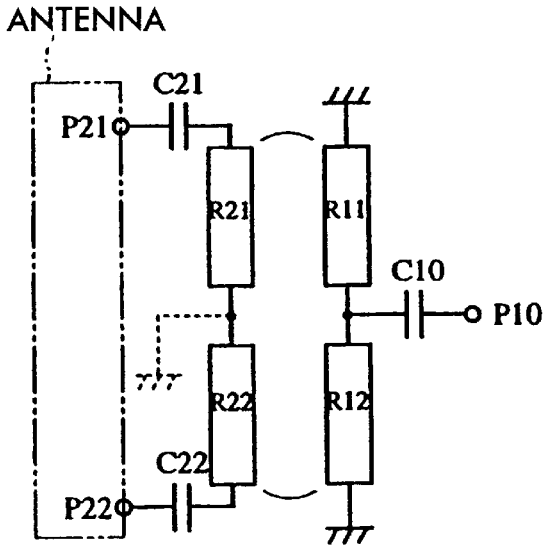

In FIG. 4D, reference characters R11 and R12 each denote λ/4 resonators wherein one-side ends thereof are each short-circuited, and wherein the other ends thereof are connected with each other. These two connected resonators R11 and R12 work as a first resonator. Reference characters R21 and R22 each denote λ/4 resonators wherein one-side ends thereof are each opened, and wherein the other ends thereof are connected with each other. These connected resonators R21 and R22 work as a second resonator. The connection point between the resonators R21 and R22 has an equivalent ground potential, and hence the connection point does not necessarily require to be actually grounded. Reference character C10 denotes an electrostatic capacitance generated between the unbalanced terminal P10 and the first resonator, and reference characters C21 and C22 each denotes electrostatic capacitances generated between the second resonator and the balanced feed antenna.

When the antenna is used as a transmission antenna, once a signal is input from the unbalanced terminal P10, each of the resonators R11 and R12 resonates as a λ/4 resonator by coupling with the signal, and each of the resonators R21 and R22 coupled with these resonators R11 and R12 also resonates as a λ/4 resonator. As a result, from the balanced terminals P21 and P22, outputs are obtained which have filter characteristics and which are different by 180 degree in phase from each other. A balanced feed to the antenna is thus performed, and an electromagnetic wave is transmitted.

Conversely, when the antenna is used as a reception antenna, a balanced signal output from the antenna is supplied between the terminals P21 and P22, each of the resonators R21 and R22 resonates as a λ/4 resonator, and an unbalanced signal is output from the terminal P10 of the resonators R11 and R12 coupled with these resonators R21 and P22.

FIGS. 5A through 5D are construction examples corresponding to the third aspect of the present invention. These examples differ from the examples shown in FIGS. 3A and 3B, in that each of the first resonators in these examples is a one-end short-circuited λ/4 resonator, and that the terminal coupling with the vicinity of the open end thereof is used as an unbalanced terminal.

Figure 5A:
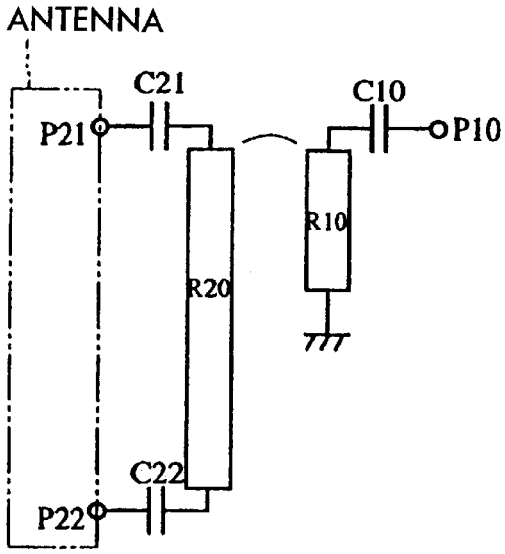
FIGS. 5A through 5D are equivalent circuit views showing an antenna device in accordance with a fifth embodiment.
Figure 5B:
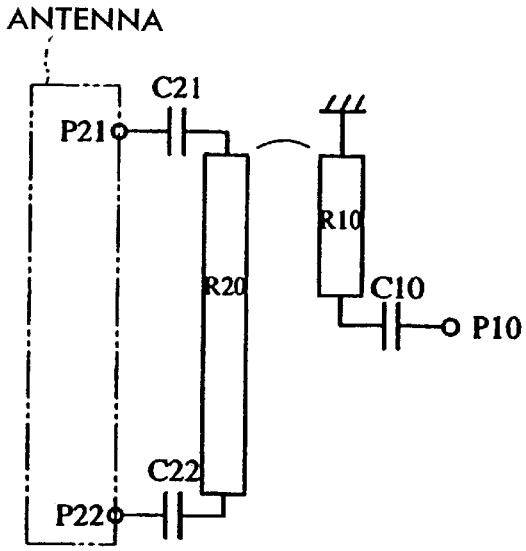
Figure 5C:
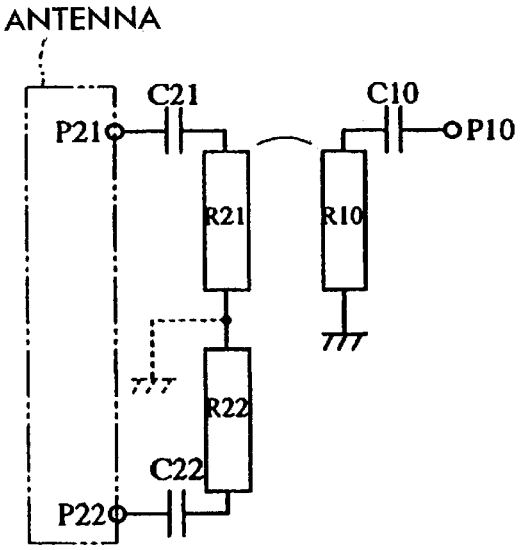
Figure 5D:
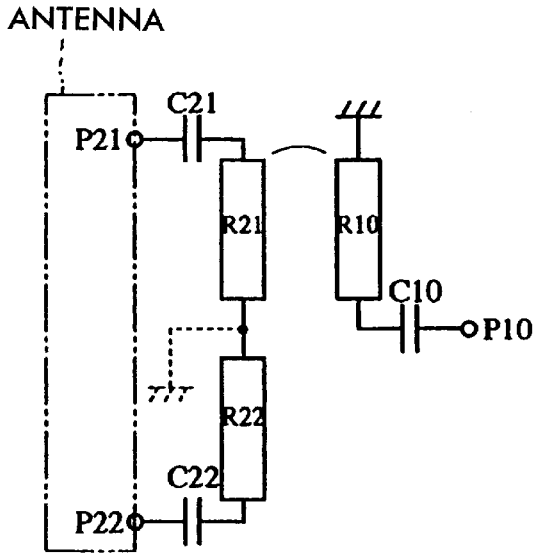

In FIGS. 5A through 5D, reference character R10 denotes a λ/4 resonator wherein one-end thereof is short-circuited, and wherein the other end thereof is opened. The resonator R10 works as a first resonator. In FIGS. 5A and 5B, reference characters R20 denotes a both-end opened λ/2 resonator. The resonator R20 works as a second resonator. In FIGS. 5C and 5D, reference characters R21 and 22 each denote λ/4 resonators wherein one-side ends thereof are opened, and wherein the other ends thereof are connected with each other. These connected resonators R21 and R22 work as a second resonator. The connection point between the resonators R21 and R22 has an equivalent ground potential, and hence does not necessarily require to be actually grounded. In FIGS. 5A through 5D, reference character C10 denotes an electrostatic capacitance generated between the unbalanced terminal P10 and the first resonator, and reference characters C21 and C22 each denotes electrostatic capacitances generated between the second resonator and the balanced feed antenna.

In FIGS. 5A and 5B, when the antenna is used as a transmission antenna, once a signal is input from the unbalanced terminal P10, the resonator R10 resonates as a λ/4 resonator by coupling with the signal, and the resonator R20 coupled with this resonator R10 resonates as a λ/2 resonator. As a result, from the balanced terminals P21 and P22, outputs are obtained which have filter characteristics and which are different by 180 degree in phase from each other. A balanced feed to the antenna is thus performed, and an electromagnetic wave is transmitted. Conversely, when the antenna is used as a reception antenna, a balanced signal output from the antenna is supplied between the terminals P21 and P22, the resonator R20 resonates as a λ/2 resonator, and an unbalanced signal is output from the terminal P10 of the resonator R10 coupled with this resonator R20.

In FIGS. 5C and 5D, when the antenna is used as a transmission antenna, once a signal is input from the unbalanced terminal P10, the resonator R10 resonates as a λ/4 resonator by coupling with the signal, and each of the resonators R21 and R22 coupled with this resonator R10 also resonates as a λ/4 resonator. As a result, from the balanced terminals P21 and P22, outputs are obtained which have filter characteristics and which are different by 180 degree in phase from each other. A balanced feed to the antenna is thus performed, and an electromagnetic wave is transmitted. Conversely, when the antenna is used as a reception antenna, a balanced signal output from the antenna is supplied between the terminals P21 and P22, the resonator R20 resonates as a λ/2 resonator, and an unbalanced signal is output from the terminal P10 of the resonator R10 coupled with this resonator R20.

FIGS. 6A through 6D are construction examples corresponding to the fourth aspect of the present invention. These examples differ from the examples shown in FIGS. 3A and 3B, in that each of these examples are provided with two terminals which couples with the vicinity of both open ends of a first resonator and which are used as balanced terminals, and that an antenna device for a balanced input-output is thereby formed.

Figure 6A:
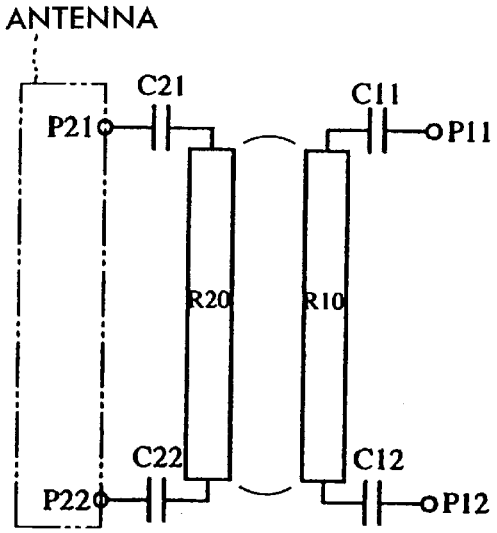
FIGS. 6A through 6D are equivalent circuit views showing an antenna device in accordance with a sixth embodiment.
Figure 6B:
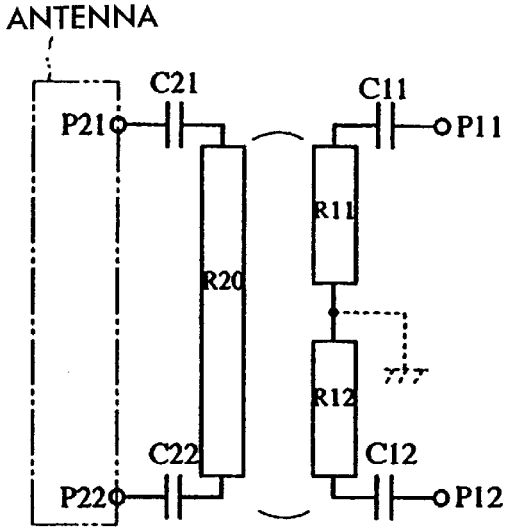
Figure 6C:
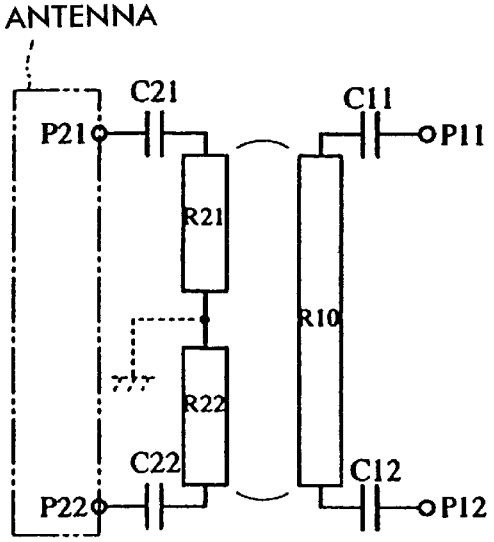
Figure 6D:
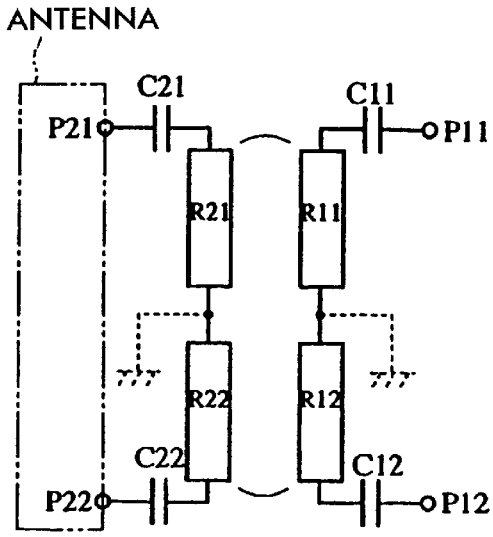

In FIGS. 6A and 6C, reference character R10 denotes a both-end opened λ/2 resonator. The resonator R10 works as a first resonator. In FIGS. 6B and 6D, reference characters R11 and R12 each denote λ/4 resonators wherein one-side ends thereof are each opened and wherein the other ends thereof are connected with each other. These two resonators R11 and R12 work as a first resonator. The connection point between the resonators R21 and R22 has an equivalent ground potential, and hence does not necessarily require to be actually grounded. In FIGS. 6A and 6B, reference character R20 denotes a both-end opened λ/2 resonator. The resonator R20 works as a second resonator. In FIGS. 6C and 6D, reference characters R21 and 22 each denote λ/4 resonators wherein one-side ends thereof are each opened, and wherein the other ends thereof are connected with each other. These connected resonators R21 and R22 work as a second resonator. The connection point between the resonators R21 and R22 has an equivalent ground potential, and hence does not necessarily require to be actually grounded. In FIGS. 6A through 6D, reference characters C11 and C12 each denote electrostatic capacitances generated between the balanced terminals P11 and P12 and the first resonator, and reference characters C21 and C22 each denotes electrostatic capacitances generated between the second resonator and the balanced feed antenna.

In FIG. 6A, when the antenna is used as a transmission antenna, once a signal is input from the balanced terminals P11 and P12, the resonator R10 resonates as a λ/2 resonator by coupling with the signal, and the resonator R20 coupled with these resonators R10 resonates as a λ/2 resonator. As a result, from the balanced terminals P21 and P22, outputs are obtained which have filter characteristics and which are different by 180 degree in phase from each other. A balanced feed to the antenna is thus performed, and an electromagnetic wave is transmitted. Conversely, when the antenna is used as a reception antenna, a balanced signal output from the antenna is supplied between the terminals P21 and P22, the resonator R20 resonates as a λ/2 resonator, and a balanced signal is output from the terminals P11 and P12 of the resonator R10 coupled with this resonator R20.

In FIG. 6B, when the antenna is used as a transmission antenna, once a signal is input from the balanced terminals P11 and P12, each of the resonators R11 and R12 resonates as a λ/4 resonator by coupling with the signal, and the resonator R20 coupled with these resonators R11 and R12 resonates as a λ/2 resonator. As a result, from the balanced terminals P21 and P22, outputs are obtained which have filter characteristics and which are different by 180 degree in phase from each other. A balanced feed to the antenna is performed, and an electromagnetic wave is transmitted. Conversely, when the antenna is used as a reception antenna, a balanced signal output from the antenna is supplied between the terminals P21 and P22, the resonator R20 resonates as a λ/2 resonator, and a balanced signal is output from the terminals P11 and P12 of the resonators R11 and R12 coupled with this resonator R20.

In FIG. 6C, when the antenna is used as a transmission antenna, once a signal is input from the balanced terminals P11 and P12, the resonator R10 resonates as a λ/2 resonator by coupling with the signal, and each of the resonators R21 and R22 coupled with this resonator R10 resonates as a λ/4 resonator. As a result, from the balanced terminals P21 and P22, outputs are obtained which have filter characteristics and which are different by 180 degree in phase from each other. A balanced feed to the antenna is thus performed, and an electromagnetic wave is transmitted. Conversely, when the antenna is used as a reception antenna, a balanced signal output from the antenna is supplied between the terminals P21 and P22, each of the resonators R21 and R22 resonates as a λ/4 resonator, and a balanced signal is output from the terminals P11 and P12 of the resonator R10 coupled with these resonators R21 and R22.

In FIG. 6D, when the antenna is used as a transmission antenna, once a signal is input from the balanced terminals P11 and P12, each of the resonators R11 and R12 resonates as a λ/4 resonator by coupling with the signal, and the resonators R21 and 22 coupled with these resonators R11 and R12 each resonate as a λ/4 resonator.

As a result, from the balanced terminals P21 and P22, outputs are obtained which have filter characteristics and which are different by 180 degree in phase from each other. A balanced feed to the antenna is thus performed, and an electromagnetic wave is transmitted. Conversely, when the antenna is used as a reception antenna, a balanced signal output from the antenna is supplied between the terminals P21 and P22, each of the resonators R21 and R22 resonates as a λ/4 resonator, each of the resonators R11 and R12 also resonates as a λ/4 resonator coupled with these resonators R21 and R22, and a balanced signal is output from the terminals P11 and P12.

In a manner such as described above, each of the antenna devices in accordance with the fourth aspect works as an antenna device for a balanced input-output.

Next, examples of the antenna devices each using a dielectric bock will be described with reference to FIGS. 7A and 7B.

Figure 7A:
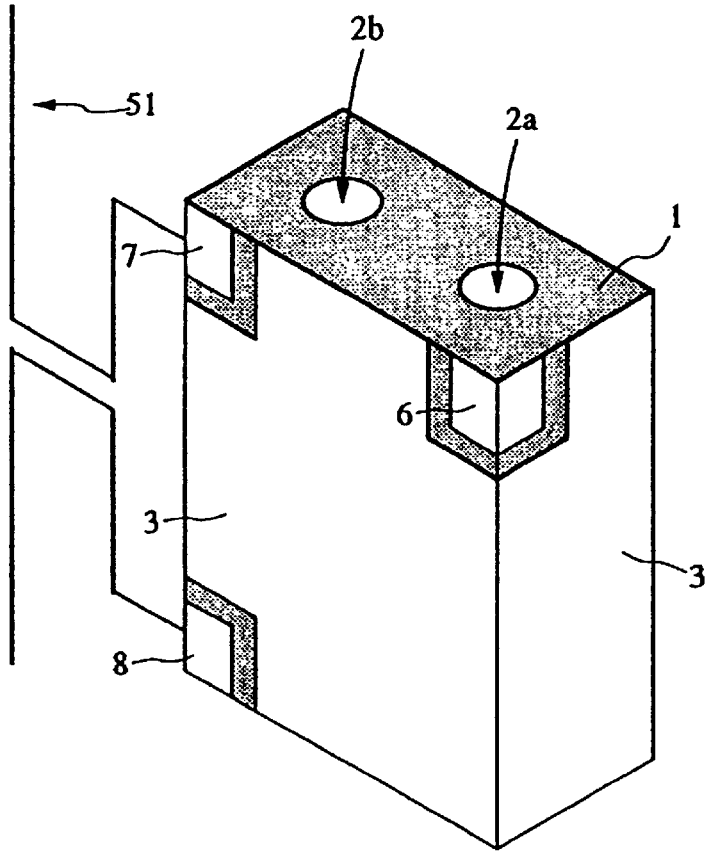
Figure 7B:
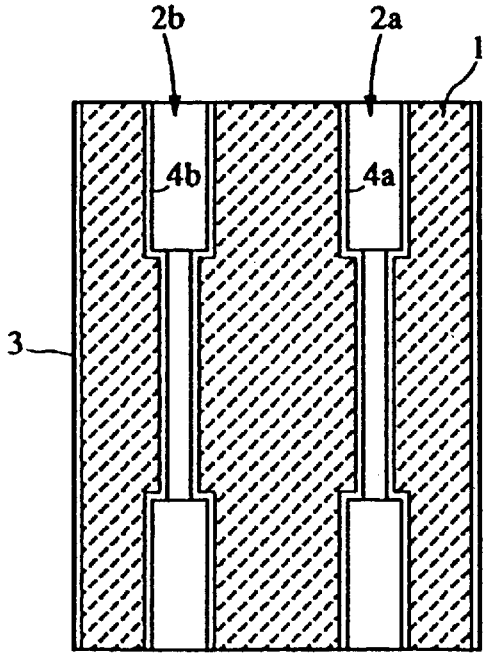

FIG. 7A is a perspective view of the main section (a dielectric filter) of the antenna device, and FIG. 7B is a vertical sectional view thereof.

When surface-mounting onto a circuit board is performed, the left front surface of this antenna device in the posture shown in FIG. 7A is opposed to the circuit board, terminal electrodes 6, 7, and 8 are connected to signal input-output electrodes on the circuit board, and outer conductors 3 are connected to a ground electrode on the circuit board.

The dielectric block 1 is formed as a substantially rectangular parallelepiped as a whole, and is provided with two inner-conductor forming holes 2*a* and 2*b*. Outer conductors 3 are each formed on the outer surfaces (four surfaces) of the dielectric block 1 except the top and bottom surfaces thereof in the figure. The inner-conductor forming hole 2*a* has an inner conductor 4*a* formed on the inner surface thereof, and the inner-conductor forming hole 2*b* has an inner conductor 4*b* formed on the inner surface thereof. On the outer surface of the dielectric block 1, a terminal electrode 6, which generates an electrostatic capacitance between this terminal electrode 6 and the vicinity of one end of the inner conductor 4*a*, and terminal electrodes 7 and 8, which generate electrostatic capacitances between these terminal electrodes 7 and 8 and the vicinities of both ends of the inner conductor 4*b*, respectively, are formed separately from the outer conductors 3.

With this structure, the inner conductors 4*a*, the dielectric block 1, and the outer conductors 3 constitute one λ/2 coaxial resonator, and the inner conductor 4*b*, the dielectric block 1, and the outer conductors 3 constitute another λ/2 coaxial resonator. Also, each of the inner-conductor forming holes are arranged so as to differ in inner diameter between the open-end side and the equivalent short-circuited end side (the central portion of the inner-conductor forming hole). By this structure, the adjacent resonators are capacitively coupled together. The dielectric filter shown in FIG. 7, therefore, can be equivalently expressed as being the same as the example shown in FIG. 1B, and can be employed as a dielectric filter wherein the terminal electrode 6 is used as an unbalanced terminal, and wherein terminal electrodes 7 and 8 are used as balanced terminals. In this example, a half-wave dipole antenna 51 is connected to the terminal electrodes 7 and 8 as balanced terminals.

In the example shown in FIG. 7, a two-stage resonator is formed, but the present invention can also be applied to the case where resonators comprising three or more stages are formed on a single dielectric block.

The example shown in FIG. 7 is arranged so as to perform an unbalanced input and output, but if the outer surface of the dielectric block 1 is provided with terminal electrodes which are capacitively coupled with the vicinities of both open ends of the inner conductor 4*a*, an antenna device of which the equivalent circuit can be expressed in the same way as FIG. 6A, can be formed. In this case, this example can be used as an antenna device having a filter for a balanced input-output.

Figure 8:
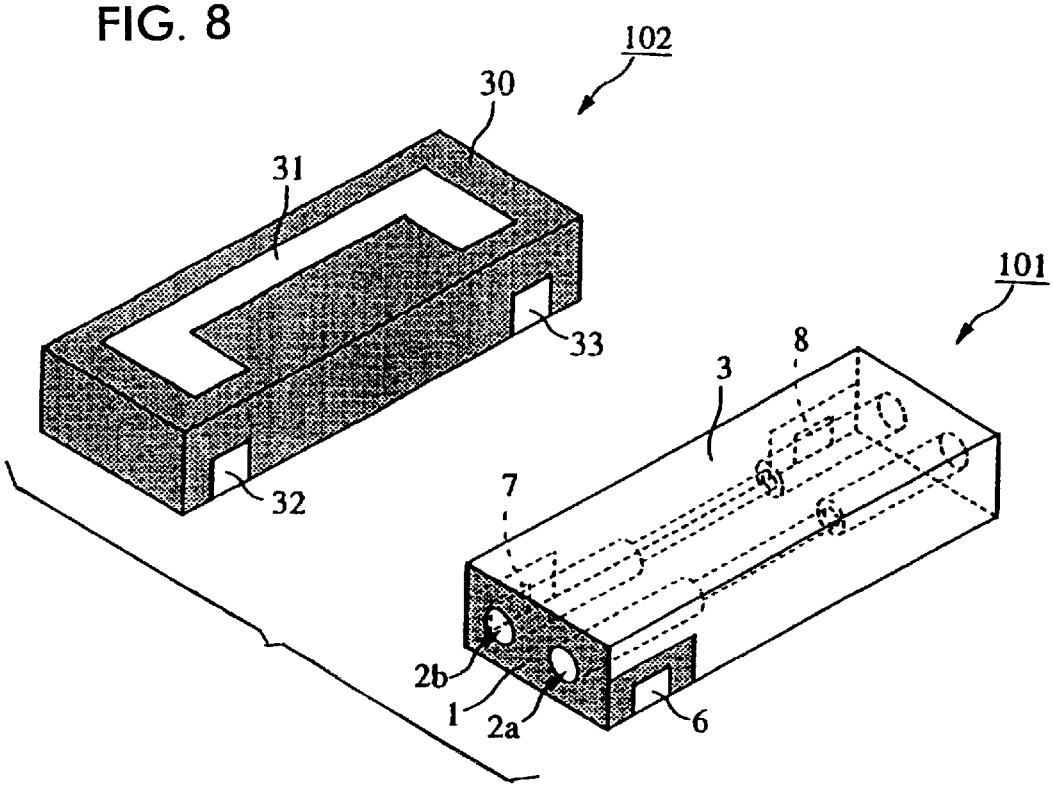
FIG. 8 is a perspective view showing the constructions of a dielectric filter and an antenna used in an antenna device in accordance with an eighth embodiment.

Next, an example in which an antenna is formed on the dielectric block is illustrated in FIG. 8. In FIG. 8, an antenna 102 has a radiation electrode 31 formed on the top surface (in the figure) of the dielectric block 30, and has terminal electrodes 32 and 33, each of which is formed from the end face on the right front side (in the figure) to one portion of the bottom surface of the dielectric block 30. As required, a ground electrode may be formed over substantially the entire surface of the bottom surface or on a portion thereof except the formation area of these terminal electrodes 32 and 33. The terminal electrodes 32 and 33 are capacitively coupled with the vicinities of the open ends of the radiation electrode 31. A distributed capacitance is generated between the radiation electrode 31 and the ground electrode on the bottom surface of the dielectric block, and the antenna 102 works as a stripline-type antenna.

On the other hand, reference numeral 101 designates a dielectric filter using a dielectric block, which has essentially the same constitution as the example shown in FIG. 7. Specifically, by providing inner-conductor forming holes 2*a* and 2*b* on the dielectric block 1, and by providing outer conductors 3 on the outer surface, a two-stage $\lambda/2$ coaxial resonator of which both ends are open, is formed. The terminal electrode 6 is capacitively coupled with the vicinity of one open end of the resonator formed by the inner-conductor forming hole 2*a*. Also, the terminal electrodes 7 and 8 are capacitively coupled with the vicinities of both open ends of the resonator formed by the inner-conductor forming hole 2*b*, respectively.

By integrally bonding the above-described antenna 102 and dielectric filter 101, the terminal electrodes 32 and 7 are made conductive to each other, and the terminal electrodes 33 and 8 are made conductive to each other. An antenna device incorporating a balanced-to-unbalanced transformer and a filter, is thereby formed.

Figure 9:
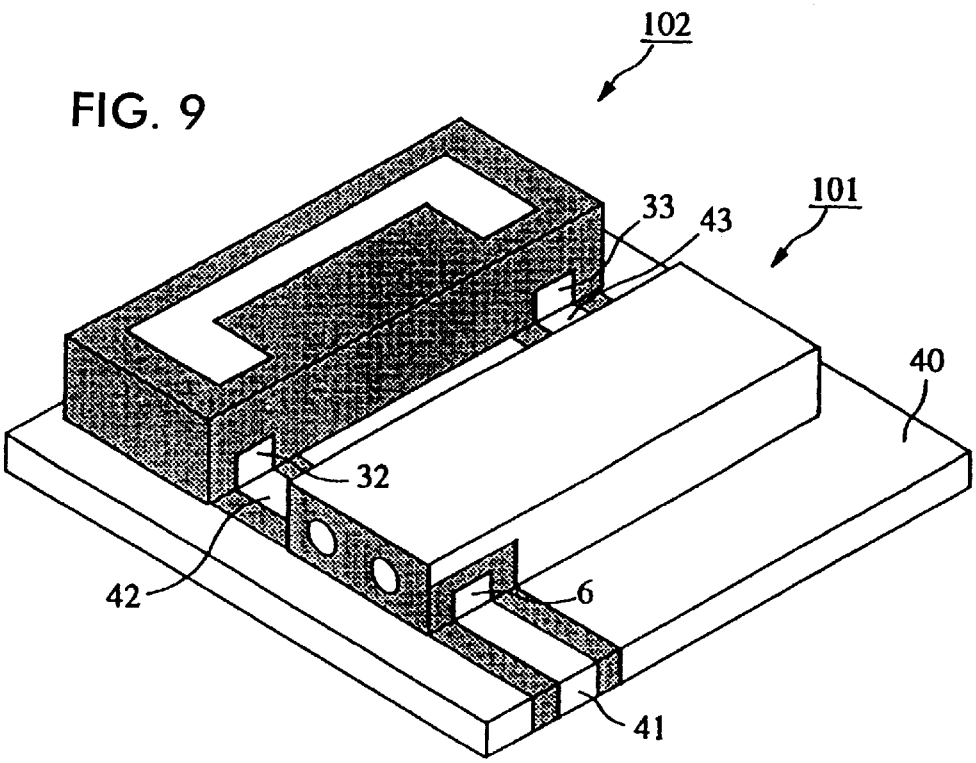
FIG. 9 is a perspective view showing the appearance of an antenna device in accordance with a ninth embodiment.

FIG. 9 is a perspective view illustrating another antenna device formed using the dielectric filter and the antenna shown in FIG. 8. As illustrated in FIG. 9, by mounting the dielectric filter 101 and the antenna 102 on a dielectric substrate 40, an antenna device as a single component including a balanced-to-unbalanced transformer and a filter, is formed. More specifically, lines 42 and 43 are formed on the dielectric substrate 40, and via these lines 42 and 43, the terminal electrodes (7 and 8 shown in FIG. 8) of the dielectric filter 101 and the terminal electrodes 32 and 33 of the antenna are connected together, respectively. Also, a terminal electrode 41 is formed on the dielectric substrate 40, and the terminal electrode 6 of the dielectric filter 101 is led out to this terminal electrode 41.

Next, examples in each of which a dielectric filter and an antenna are provided on a single dielectric block will be described with reference to FIGS. 10 through 12.

Figure 10:
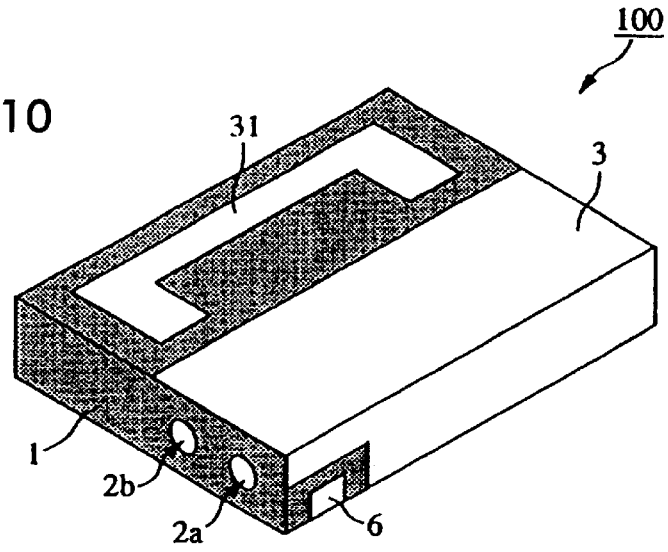
FIG. 10 is a perspective view showing the appearance of an antenna device in accordance with a tenth embodiment.

In the example shown in FIG. 10, the dielectric filter portion is constructed by providing inner-conductor forming holes 2*a* and 2*b* each of which has a inner conductor formed on the inner surfaces thereof, and providing outer conductors 3 and a terminal electrode 6 on the outer surface, in the dielectric block 1. Also, the antenna portion is constructed by forming a radiation electrode 31 on the top surface of the same dielectric block 1. The constitutions of these dielectric filter portion and antenna portion are the same as those of the dielectric filter 101 and the antenna 102 shown in FIG. 8. However, the terminal electrodes corresponding to the terminal electrodes 7, 8, 32, and 33 shown in FIG. 8 are not provided within the dielectric block 1. Therefore, the vicinities of both open ends of the radiation electrode 31 and the vicinities of both open ends of the both-end opened $\lambda/2$ resonator formed by the inner-conductor forming hole 2*b* are directly capacitively coupled, respectively.

Meanwhile, the dielectric filter portion and the antenna portion in the dielectric block 1 may be arranged so as to differ in their effective permittivity. For example, when the dielectric block 1 is molded, a dielectric ceramic material having a high dielectric constant and one having a relatively low dielectric constant are integrally molded, and, for example, the area where the dielectric constant is higher is used as a dielectric filter portion, while the area where the dielectric constant is lower is used as an antenna portion. Alternatively, the area where the dielectric constant is higher is used as the antenna portion, while the area where the dielectric constant is lower is used as the dielectric filter portion.

Figure 11A:
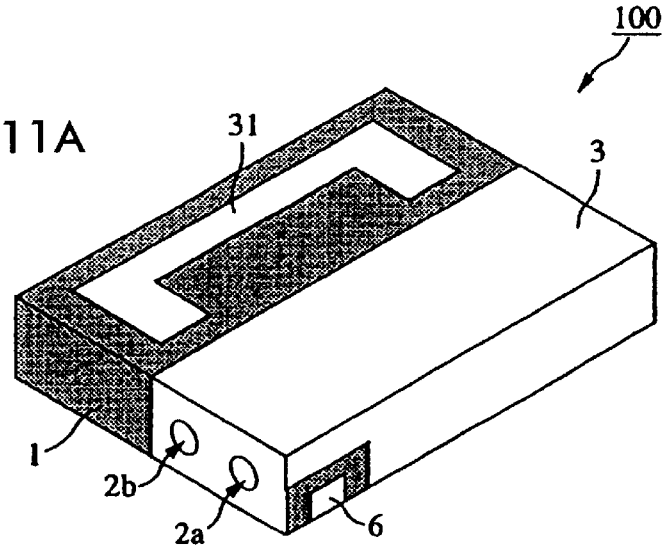
Figure 11B:
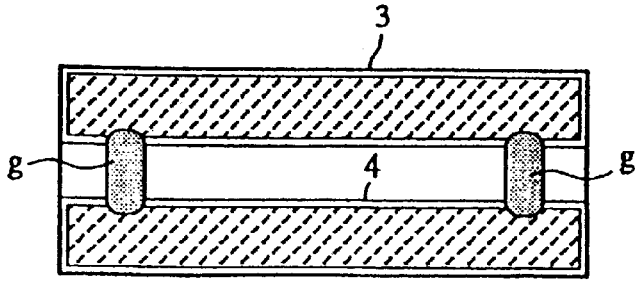

FIG. 11A is a perspective view illustrating the appearance of an antenna device. FIG. 11B is a vertical sectional view taken along the plane passing the central axis of an inner-conductor forming hole in FIG. 11A. In the example shown in FIG. 10, the open surfaces of both ends of the inner-conductor forming holes 2*a* and 2*b* are arranged so as to be open surfaces without outer conductors 3. However, the example shown in FIG. 11 is arranged so that outer conductors are formed also on the open surfaces of both ends of the inner-conductor forming holes 2*a* and 2*b*, that electrode non-formed portions g are provided within the vicinities of the open surfaces, and that both ends of the inner conductor 4 are opened at these electrode non-formed portions, as well as stray capacitances are each generated between the open ends and the outer conductors 3 (ground). By this structure, two both-end opened $\lambda/2$ resonators formed by the inner-conductor forming holes 2*a* and 2*b* are inductively coupled together. Also, the vicinities of both open ends of the radiation electrode 31 and the vicinities of both open ends of the inner conductor within the inner-conductor forming hole 2*b* are each capacitively coupled.

Figure 12:
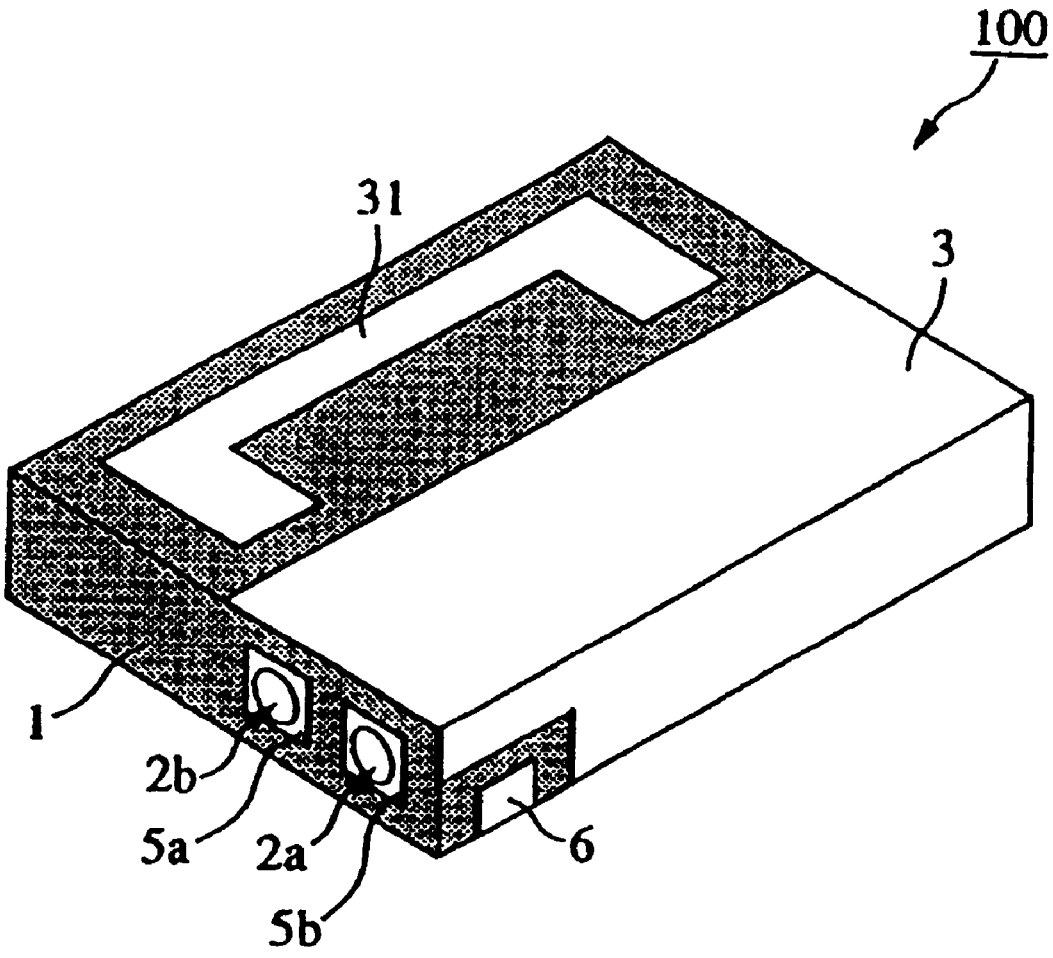
FIG. 12 is a perspective view illustrating the appearance of an antenna device in accordance with a twelfth embodiment.

The example shown in FIG. 12 differs from the example shown in FIG. 10 in that coupling electrodes 5*a* and 5*b* communicating with the inner conductor are formed at the opening portions of the inner-conductor forming holes 2*a* and 2*b*, and that the resonators are coupled with each other by the electrostatic capacitance between these coupling electrodes 5*a* and 5*b*. The remaining construction is the same as that shown in FIG. 10. The vicinities of both open ends of the radiation electrode 31 in the antenna portion are capacitively coupled with the vicinities of both open ends of the inner conductor within the inner-conductor forming hole 2*b*, respectively.

Next, the construction of an antenna device including a dielectric duplexer will be described with reference to FIGS. 13 and 14.

FIG. 13A is perspective view showing the appearance of the dielectric duplexer portion, and FIG. 13B is a vertical sectional view taken along the plane passing all inner-conductor forming holes. When the surface-mounting onto the circuit board of a communication device is performed, the left front surface of this antenna device in the posture shown in FIG. 13A is opposed to a circuit board, terminal electrodes 6 and 9 are connected to signal input-output electrodes on the circuit board, and outer conductors 3 are connected to a ground electrode on the circuit board.

The dielectric block 1 is formed as a substantially rectangular parallelepiped as a whole, and is provided with six inner-conductor forming holes 2*a*, 2*b*, 2*c*, 2*d*, 2*e*, and 2*f*. Outer conductors 3 are each formed on the outer surfaces (four surfaces) of the dielectric block 1 except the top and bottom end faces thereof (in the figure). The inner-conductor forming holes 2*a* through 2*f* have inner conductors 4*a* through 4*f* formed on the inner surfaces thereof, respectively. On the outer surface of the dielectric block 1, there are formed terminal electrodes 6 and 9 which generate electrostatic capacitances between these terminal electrodes 6 and 9 and the vicinities of one-side ends of the inner conductor 4*a* and 4*f*, respectively.

With this structure, each of the inner conductors 4*a* through 4*f*, the dielectric block 1, and the outer conductors 3 constitute a $\lambda/2$ coaxial resonator.

The resonators formed by the above-described inner conductors 4*a*, 4*b* and 4*c* are used as a transmission filter, and the resonators formed by the above-described inner conductors 4*d*, 4*e* and 4*f* are used as a reception filter. In this case, the terminal electrode 6 is employed as an unbalanced transmission-signal input terminal and the terminal electrode 9 is employed as an unbalanced reception-signal output terminal.

FIG. 14A is a perspective view illustrating other outer surfaces of the above-described dielectric duplexer portion. Herein, the terminal electrodes 7 and 8 are disposed at the positions where these terminal electrodes 7 and 8 are capacitively coupled with the vicinities of the open ends of the inner conductors 4*c* and 4*d* shown in FIG. 13B, respectively.

FIG. 14B illustrates the state wherein an antenna 102 has been bonded to the top surface of the dielectric block, in comparison with the state shown in FIG. 14A. The construction of the antenna 102 is substantially the same as that shown in FIG. 8. By this structure, the vicinities of both open-ends of the radiation electrode 31 are capacitively coupled with the terminal electrodes 7 and 8 of the dielectric duplexer, respectively.

In such a manner, a dielectric duplexer which inputs an unbalanced transmitted signal and which outputs an unbalanced received signal, and a balanced feed antenna are formed.

Meanwhile, in the above-described dielectric filter and dielectric duplexer, the dielectric filter or the dielectric duplexer has been constructed by forming a coaxial resonator on a single dielectric block. However, the dielectric filter or the dielectric duplexer may instead be constructed by bonding together blocks in each of which inner conductors are formed in a dielectric substrate with grooves previously formed, and by forming thereby a coaxial resonator.

Also, in the example shown in FIG. 14, the antenna portion and the dielectric duplexer portion have been integrally bonded, but in the same manner as the example shown in FIG. 10, the antenna portion and the dielectric duplexer portion may be installed on a single dielectric block.

Next, examples of the antenna device each having a filter utilizing a resonance mode other than the TEM mode will be described with reference to FIGS. 15A through 15C and 16.

In FIG. 15A, reference numeral 102 designates a stripline-type antenna similar to the one shown in FIG. 8. The antenna 102 forms a radiation antenna 31 on the top surface (in the figure) of the dielectric block 30, and forms terminal electrodes 32 and 33 from right front end face (in the figure) to one portion of the bottom surface of the dielectric block 30.

On the other hand, reference numeral 101 designates a dielectric filter using a dielectric block, which is essentially a dielectric filter constituting a wave-guide type resonator. FIG. 15B is a vertical sectional view taken along the line B—B in FIG. 15A. FIG. 15C is a diagram for explaining the operation of the dielectric filter 101, and illustrates the state in which the dielectric filter 101 has been separated into two dielectric filters which are equivalent to the dielectric filter 101 in a fundamental wave portion. FIG. 15B is also a vertical sectional view taken along the line B—B in FIG. 15C.

Here, the two dielectric filters 101*a* and 101*b* shown in FIG. 15C will be described. The dielectric block 1 of each of these dielectric filters 101*a* and 101*b* is formed as a substantially rectangular parallelepiped as a whole, and forms outer conductors 3 on the outer surface thereof. A two-stage resonator is constructed by forming, halfway in the longitudinal direction of the dielectric block, grooves 21 and 22 which constitute nodes dividing the longitudinal direction length. Outer conductors 3 are each formed on the inner surfaces of the grooves 21 and 22. Each of the areas divided by the grooves 21 and 22 works as a resonator in the TE101 mode. These resonator areas are provided with through holes 26, 27, 28, and 29 passing through the dielectric blocks in the direction of the short axes thereof. The inner surfaces of the through holes 26, 27, 28, and 29 have no conductor films formed thereon. On the right front surfaces (in the FIG. 15C) of the dielectric blocks, terminal electrodes 6 and 11 are formed. On the left rear surfaces opposed to these terminal electrodes 6 and 11, terminal electrodes are also formed.

Next, a description of the dielectric filter 101*a* will be given. The resonance frequency of each stage of the above-described two-stage resonators is determined by the inner diameters of the through holes 26 and 27. Also, the coupling coefficient between the two resonators of the two-stage resonator is determined by the size of the groove 21, etc. As shown in FIG. 15B, within the dielectric block, through holes 34 and 35 are formed from the terminal electrodes 6 and 7 on the end faces of the dielectric block 1 to the conductor films 3 on the bottom surface of the dielectric block 1. On the inner surfaces of the through holes 34 and 35, coupling electrodes 36 and 37 for coupling with the TE101 mode are formed. With this structure, a dielectric wave-guide type filter is achieved which comprises a two-step resonator using the two terminal electrodes 6 and 7 as input-output portions and which has band-pass characteristics. The filter characteristics of this dielectric filter 101*a* are determined by the resonance frequency and the coupling coefficient of the two-stage resonator. The same goes for the other dielectric filter 101*b*.

The dielectric filter 101 in FIG. 15A equals the above-described dielectric filter 101*a* and 101*b* which has integrally been bonded together at sides thereof. In this example, however, there are provided no grooves on the sides corresponding to the bonded surfaces and no outer conductors on the surfaces corresponding to the bonded surfaces. By thus providing two filters each comprising a two-stage resonator in the TE101 mode, and by operating these two filter with a phase difference of 180 degrees, the dielectric filter 101 works as a balanced input-output type dielectric filter. In this case, the dielectric filter 101, as a whole, works as a filter comprising a two-stage resonator in the TE201 mode.

FIG. 16 is a perspective view illustrating the antenna device constructed using the antenna 102 and the dielectric filter 101 each shown in FIG. 15. This antenna device is obtained by integrally bonding the antenna 102 and the dielectric filter 101 each shown in FIG. 15, and by making the two terminal electrodes of the left rear end face (in FIG.

16) of the dielectric filter conductive to the terminal electrodes 32 and 33 of the antenna, respectively.

With this structure, there is formed an antenna device which incorporates a balanced-to-unbalanced transformer and a filter, and which is usable even in a high-frequency such that the filter is difficult to form in a TEM mode resonator.

In the examples shown in FIGS. 15A through 15C, and FIG. 16, the two terminal electrodes 6 and 11 have been provided on the dielectric filter, and these two terminal electrodes have been used as the terminal electrodes for a balanced input-output. Alternately, however, an unbalanced input-output antenna device may be formed by providing only one terminal electrode or by using only one terminal electrode, out of the two terminal electrodes. Specifically, if an unbalanced signal is input to any one of the terminal electrodes represented by, for example, the electrodes 6 and 11, the area from these terminals to the grooves 21 and 22 resonates in the TE201 mode, so that the above-mentioned unbalanced input-output antenna device can be used in the same manner as a balanced input-output antenna device.

In the above-described example, the TE mode as a resonance mode has been utilized for the filter portion, but any other resonance mode apart from the TEM mode may be utilized, such as TM mode.

Also, in the above-described example, the antenna and dielectric filter which were originally separate from each other have integrally been bonded, but an antenna device as shown in FIG. 16 may be formed by providing a single dielectric block with an antenna portion and a dielectric filter portion. However, the electrodes corresponding to the bonded surfaces between the antenna and the dielectric filter do not require to be provided within the dielectric block. In this case, the vicinities of both open-ends of the radiation electrode 31 and the resonator mode of the filter are directly coupled together.

Furthermore, even when the antenna portion and the filter portion are formed on a single dielectric block, the antenna portion and the filter portion may differ in effective permittivity.

Moreover, as in the case of the antenna device shown in FIG. 9, the antenna device may be formed as a whole by each mounting an antenna and a dielectric filter on the substrate.

Next, the construction of the communication device using the above-described dielectric filter or dielectric duplexer will be described with reference to FIG. 17.

In FIG. 17, the portion surrounded by a square is an antenna device comprising a duplexer DPX and transmission/reception antenna ANT. Here, BPFa, BPFb, and BPFc are each band-pass filters, AMPa, AMPb are each amplifier circuits, MIXa and MIXb are each mixers, OSC is an oscillator, and DIV is a divider. The MIXa modifies the frequency signal output from the DIV with the intermediate-frequency signal IF of a transmitted signal, the BPFa passes only the band of a transmission frequency, and the AMPa power-amplifies it and transmits it the ANT via the DPX. The AMPb amplifies the received signal from the DPX, and the BPFb passes only the reception frequency band in the amplified signal. The MIXb mixes the frequency signal and the received signal each output from the BPFc, and outputs the intermediate-frequency signal IF of the received signal.

As an antenna device having the duplexer DPX shown in FIG. 17, the duplexer having the structure shown in FIG. 14A is used. A communication device which is compact in its entirety is thereby formed.

In accordance with the present invention, through the use of an unbalanced terminal and balanced terminals, a balanced-to-unbalanced transformation is performed, the pass or the attenuation of a predetermined frequency band is executed, and a balanced feed to an antenna is performed. That is, when the antenna device in accordance with the present invention is used as a reception antenna device, a balanced signal passes through the filter and is output as an unbalanced signal. Conversely, when the antenna device is used as a transmission antenna device, an unbalanced signal is input, passes through the filter, and after the signal has been feeding balanced manner to the antenna, an electromagnetic wave is emitted.

This eliminates the need for a balanced-to-unbalanced transformer dedicated to the present antenna device. In addition, since the filter and the antenna is integrally formed, the number of components to be used is reduced, and the footprint of the communication device on the substrate is decreased.

Also, in accordance with the present invention, by forming each of the $\lambda/2$ resonators and $\lambda/4$ resonators with a microstrip line, each of the resonators can be easily constructed on the dielectric substrate, and the connection thereof with other components formed on the dielectric substrate is facilitated.

Furthermore, in accordance with the present invention, by constituting the resonator of a dielectric coaxial resonator formed by providing a conductor film on the dielectric block, a compact antenna device having a low loss and a low parasitic emission characteristic can be easily formed.

In addition, in accordance with the present invention, by using a filter in a mode other than the TEM mode, the filter portion becomes usable even in a high-frequency band where such filters are difficult to form as a TEM mode resonator.

Moreover, in accordance with the present invention, the dielectric filter and the antenna are integrally formed by connecting the balanced input-output portion of the dielectric filter and the balanced feed antenna on the line of a substrate. Hence, when mounting the antenna device on the circuit board of a communication device, the terminal provided on the substrate of the antenna device has only to be made conductive to the terminal provided on the substrate of the communication device. The antenna device and the communication device can thus be treated as a single component.

Also, in accordance with the present invention, the balanced input-output portion of the dielectric filter and the balanced feed antenna are directly connected by bonding the dielectric filter and the balanced feed antenna. This allows the dielectric filter and the antenna to be separately produced, and allows each of the dielectric filter and the antenna to be produced by a producing method suitable therefor. Also, this enables the dielectric filter and the antenna to be integrated without the need for using other components such as a substrate, which results in a reduction in the entire size.

Further, in accordance with the present invention, by constructing the balanced feed antenna on the dielectric block wherein a balanced feed terminal is formed on the outer surface thereof, the mounting of the antenna onto the substrate is facilitated. Also, in one embodiment, the bonding of the antenna to the dielectric filter provided on the dielectric block is facilitated.

Furthermore in accordance with present invention, by forming the balanced feed antenna and the dielectric filter integrally with the dielectric block, the number of components to be used is reduced, and the footprint of the communication device on the substrate is significantly decreased.

In addition, in accordance with the present invention, the effective permittivity of the dielectric block is made different between the balanced feed antenna portion and the dielectric filter portion on the integrated dielectric block. Each of the antenna and the dielectric filter can thereby be formed with respect to the dielectric block which has the respective optimum dielectric constant in the antenna portion and the dielectric filter portion, so that an high-efficiency antenna and a dielectric filter applied to a predetermined frequency band can be formed within a limited space.

Moreover, in accordance with the present invention, a compact and lightweight communication device having a superior stability can be achieved.

While the invention has been described in its preferred embodiments, numerous modifications and variations of the present invention are possible in light of the above teachings. It is therefore to be understood that within the scope of the appended claims, the invention may be practiced otherwise than as specifically described.

What is claimed is:

1. An antenna device comprising:

a first resonator formed by opening both ends of a λ/2 TEM resonator;

a second resonator formed by at least one of:
opening both ends of two λ/4 TEM resonators which are connected together; and
opening both ends of a λ/2 TEM resonator;

a dielectric filter in which the first and second resonators are coupled together, in which a portion connected to a vicinity of one of the open ends of the first resonator is used as an unbalanced input-output portion, and in which a portion connected to the second resonator is used as a balanced input-output portion; and a balanced feed antenna coupled with said balanced input-output portion.

2. An antenna device comprising:

a first resonator formed by at least one of:
short-circuiting both ends of two λ/4 TEM resonators which are connected together, and
short-circuiting both ends of a λ/2 TEM resonator;

a second resonator formed by at least one of:
opening both ends of two λ/4 TEM resonators which are connected together, and
opening both ends of a λ/2 TEM resonator;

a dielectric filter in which the first and second resonators are coupled together, in which a portion connected to a vicinity of an equivalent open end of the first resonator is used as an unbalanced input-output portion, and in which a portion connected to the second resonator is used as a balanced input-output portion; and a balanced feed antenna coupled with said balanced input-output portion.

3. An antenna device comprising:

a first resonator formed by short-circuiting one end of a λ/4 TEM resonator;

a second resonator formed by at least one of:
opening both ends of two λ/4 TEM resonators which are connected together, and
opening both ends of a λ/2 TEM resonator;

a dielectric filter in which the first and second resonators are coupled together, in which a portion connected to a vicinity of the open end of the first resonator is used as an unbalanced input-output portion, and in which a portion connected to the second resonator is used as a balanced input-output portion; and a balanced feed antenna coupled with said balanced input-output portion.

4. An antenna device comprising:

a first resonator formed by at least of:
opening both ends of two λ/4 TEM resonators which are connected together, and
opening both ends of a λ/2 TEM resonator;

a second resonator formed by at least one of:
opening both ends of two λ/4 TEM resonators which are connected together, and
opening both ends of a λ/2 TEM resonator;

a dielectric filter in which the first and second resonators are coupled together, in which a portion connected to vicinities of the open ends of the first resonator is used as a first balanced input-output portion, and in which a portion connected to vicinities of the open ends of the second resonator is used as a second balanced input-output portion; and a balanced feed antenna coupled with said first or second balanced input-output portions.

5. The antenna device as claimed in claim 1, wherein:

each of said λ/2 TEM resonator and λ/2 TEM resonator comprises a microstrip line or a strip line.

6. The antenna device as claimed in claim 2, wherein:

each of said λ/2 TEM resonator and λ/4 TEM resonator comprises a microstrip line or a strip line.

7. The antenna device as claimed in claim 3, wherein:

each of said λ/2 TEM resonator and λ/4 TEM resonator comprises a microstrip line or a strip line.

8. The antenna device as claimed in claim 4, wherein:

each of said λ/2 TEM resonator and λ/4 TEM resonator comprises a microstrip line or a strip line.

9. The antenna device as claimed in claim 1, wherein:

each of said λ/2 TEM resonator and λ/4 TEM resonator comprises a dielectric coaxial resonator formed by providing a conductor film on a dielectric block.

10. The antenna device as claimed in claim 2, wherein:

each of said λ/2 TEM resonator and λ/4 TEM resonator comprises a dielectric coaxial resonator formed by providing a conductor film on a dielectric block.

11. The antenna device as claimed in claim 3, wherein:

each of said λ/2 TEM resonator and λ/4 TEM resonator comprises a dielectric coaxial resonator formed by providing a conductor film on a dielectric block.

12. The antenna device as claimed in claim 4, wherein:

each of said λ/2 TEM resonator and λ/4 TEM resonator comprises a dielectric coaxial resonator formed by providing a conductor film on a dielectric block.

13. An antenna device comprising:

a dielectric filter having a resonator which resonates in modes other than the TEM mode and which is constructed by forming a conductor film on an outer surface of a dielectric block, and having a balanced input-output portion coupled with said resonator; and a balanced feed antenna coupled with said balanced input-output portion.

14. The antenna device as claimed in claim 1, wherein:

said dielectric filter is used as a dielectric duplexer comprising a transmission filter and a reception filter.

15. The antenna device as claimed in claim 2, wherein:

said dielectric filter is used as a dielectric duplexer comprising a transmission filter and a reception filter.

16. The antenna device as claimed in claim 3, wherein:

said dielectric filter is used as a dielectric duplexer comprising a transmission filter and a reception filter.

17. The antenna device as claimed in claim 4, wherein:

said dielectric filter is used as a dielectric duplexer comprising a transmission filter and a reception filter.

18. The antenna device as claimed in claim 13, wherein:

said dielectric filter is used as a dielectric duplexer comprising a transmission filter and a reception filter.

19. The antenna device as claimed in claim 1, wherein:

the balanced input-output portion of said dielectric filter and said balanced feed antenna are connected together on a line of a substrate.

20. The antenna device as claimed in claim 2, wherein:

the balanced input-output portion of said dielectric filter and said balanced feed antenna are connected together on a line of a substrate.

21. The antenna device as claimed in claim 3, wherein:

the balanced input-output portion of said dielectric filter and said balanced feed antenna are connected together on a line of a substrate.

22. The antenna device as claimed in claim 4, wherein:

the balanced input-output portion of said dielectric filter and said balanced feed antenna are connected together on a line of a substrate.

23. The antenna device as claimed in claim 13, wherein:

the balanced input-output portion of said dielectric filter and said balanced feed antenna are connected together on a line of a substrate.

24. The antenna device as claimed in claim 1, wherein:

the balanced input-output portion of said dielectric filter and said balanced feed antenna are directly connected together by bonding said dielectric filter and said balanced feed antenna.

25. The antenna device as claimed in claim 2, wherein:

the balanced input-output portion of said dielectric filter and said balanced feed antenna are directly connected together by bonding said dielectric filter and said balanced feed antenna.

26. The antenna device as claimed in claim 3, wherein:

the balanced input-output portion of said dielectric filter and said balanced feed antenna are directly connected together by bonding said dielectric filter and said balanced feed antenna.

27. The antenna device as claimed in claim 4, wherein:

the balanced input-output portion of said dielectric filter and said balanced feed antenna are directly connected together by bonding said dielectric filter and said balanced feed antenna.

28. The antenna device as claimed in claim 13, wherein:

the balanced input-output portion of said dielectric filter and said balanced feed antenna are directly connected together by bonding said dielectric filter and said balanced feed antenna.

29. The antenna device as claimed in claim 1, wherein:

said balanced feed antenna is constructed on a dielectric block in which a balanced feed terminal is formed on an outer surface thereof.

30. The antenna device as claimed in claim 2, wherein:

said balanced feed antenna is constructed on a dielectric block in which a balanced feed terminal is formed on an outer surface thereof.

31. The antenna device as claimed in claim 3, wherein:

said balanced feed antenna is constructed on a dielectric block in which a balanced feed terminal is formed on an outer surface thereof.

32. The antenna device as claimed in claim 4, wherein:

said balanced feed antenna is constructed on a dielectric block in which a balanced feed terminal is formed on an outer surface thereof.

33. The antenna device as claimed in claim 13, wherein:

said balanced feed antenna is constructed on a dielectric block in which a balanced feed terminal is formed on an outer surface thereof.

34. The antenna device as claimed in claim 1, wherein:

said balanced feed antenna and said dielectric filter are formed integrally with a dielectric block.

35. The antenna device as claimed in claim 2, wherein:

said balanced feed antenna and said dielectric filter are formed integrally with a dielectric block.

36. The antenna device as claimed in claim 3, wherein:

said balanced feed antenna and said dielectric filter are formed integrally with a dielectric block.

37. The antenna device as claimed in claim 4, wherein:

said balanced feed antenna and said dielectric filter are formed integrally with a dielectric block.

38. The antenna device as claimed in claim 13, wherein:

said balanced feed antenna and said dielectric filter are formed integrally with a dielectric block.

39. The antenna device as claimed in claim 34, wherein:

an effective permittivity of said dielectric block is different between a portion of said dielectric block comprising said balanced feed antenna and a portion of said dielectric block comprising said dielectric filter.

40. The antenna device as claimed in claim 35, wherein:

an effective permittivity of said dielectric block is different between a portion of said dielectric block comprising said balanced feed antenna and a portion of said dielectric block comprising said dielectric filter.

41. The antenna device as claimed in claim 36, wherein:

an effective permittivity of said dielectric block is different between a portion of said dielectric block comprising said balanced feed antenna and a portion of said dielectric block comprising said dielectric filter .

42. The antenna device as claimed in claim 37, wherein:

an effective permittivity of said dielectric block is different between a portion of said dielectric block comprising said balanced feed antenna and a portion of said dielectric block comprising said dielectric filter.

43. The antenna device as claimed in claim 38, wherein:

an effective permittivity of said dielectric block is different between a portion of said dielectric block comprising said balanced feed antenna and a portion of said dielectric block comprising said dielectric filter.

44. A communication device comprising at least one of a transmitter and a receiver, and an antenna device coupled to the at least one of the transmitter and receiver, the antenna device comprising:

a first resonator formed by opening both ends of a $\lambda/2$ TEM resonator;

a second resonator formed by at least one of:

opening both ends of two $\lambda/4$ TEM resonators which are connected together, and opening both ends of a $\lambda/2$ TEM resonator;

a dielectric filter in which the first and second resonators are coupled together, in which a portion connected to a vicinity of one of the open ends of the first resonator is used as an unbalanced input-output portion, and in which a portion connected to the second resonator is used as a balanced input-output portion; and a balanced feed antenna coupled with said balanced input-output portion.

45. A communication device comprising at least one of a transmitter and a receiver, and an antenna device coupled to the at least one of the transmitter and receiver, the antenna device comprising:

a first resonator formed by at least one of:

short-circuiting both ends of two λ/4 TEM resonators which are connected together, short-circuiting both ends of a λ/2 TEM resonator;

a second resonator formed by at least one of:

opening both ends of two λ/4 TEM resonators which are connected together, and opening both ends of a λ/2 TEM resonator;

a dielectric filter in which the first and second resonators are coupled together, in which a portion connected to a vicinity of an equivalent open end of the first resonator is used as an unbalanced input-output portion, and in which a portion connected to the second resonator is used as a balanced input-output portion; and a balanced feed antenna coupled with said balanced input-output portion.

46. A communication device comprising at least one of a transmitter and a receiver, and an antenna device coupled to the at least one of the transmitter and receiver, the antenna device comprising:

a first resonator formed by short-circuiting one end of a λ/4 TEM resonator;

a second resonator formed by at least one of:

opening both ends of two λ/4 TEM resonators which are connected together, and opening both ends of a λ/2 TEM resonator;

a dielectric filter in which the first and second resonators are coupled together, in which a portion connected to a vicinity of the open end of the first resonator is used as an unbalanced input-output portion, and in which a portion connected to the second resonator is used as a balanced input-output portion; and a balanced feed antenna coupled with said balanced input-output portion.

47. A communication device comprising at least one of a transmitter and a receiver, and an antenna device coupled to the at least one of the transmitter and receiver, the antenna device comprising:

a first resonator formed by at least one of:

opening both ends of the two λ/4 TEM resonators which are connected together, and opening both ends of a λ/2 TEM resonator;

a second resonator formed by at least one of:

opening both ends of two λ/4 TEM resonators which are connected together, and opening both ends of a λ/2 TEM resonator;

a dielectric filter in which the first and second resonators are coupled together, in which a portion connected to vicinities of the open ends of the first resonator is used as a first balanced input-output portion, and in which a portion connected to vicinities of the open ends of the second resonator is used as a second balanced input-output portion; and a balanced feed antenna coupled with said first or second balanced input-output portions.

48. The communication device of claim 44, wherein each of said λ/2 TEM resonator and λ/4 TEM resonator comprises a microstrip line or a strip line.

49. The communication device of claim 45, wherein each of said λ/2 TEM resonator and λ/4 TEM resonator comprises a microstrip line or a strip line.

50. The communication device of claim 46, wherein each of said λ/2 TEM resonator and λ/4 TEM resonator comprises a microstrip line or a strip line.

51. The communication device of claim 47, wherein each of said λ/2 TEM resonator and λ/4 TEM resonator comprises a microstrip line or a strip line.

52. The communication device of claim 44, wherein:

each of said λ/2 TEM resonator and λ/4 TEM resonator comprises a dielectric coaxial resonator formed by providing a conductor film on a dielectric block.

53. The communication device of claim 45, wherein:

each of said λ/2 TEM resonator and λ/4 TEM resonator comprises a dielectric coaxial resonator formed by providing a conductor film on a dielectric block.

54. The communication device of claim 46, wherein:

each of said λ/2 TEM resonator and λ/4 TEM resonator comprises a dielectric coaxial resonator formed by providing a conductor film on a dielectric block.

55. The communication device of claim 47, wherein:

each of said λ/2 TEM resonator and λ/4 TEM resonator comprises a dielectric coaxial resonator formed by providing a conductor film on a dielectric block.

56. A communication device comprising at least one of a transmitter and a receiver, and an antenna device coupled to the at least one of the transmitter and receiver, the antenna device comprising:

a dielectric filter having a resonator which resonates in modes other than the TEM mode and which is constructed by forming a conductor film on an outer surface of a dielectric block, and having a balanced input-output portion coupled with said resonator; and a balanced feed antenna coupled with said balanced input-output portion.

57. The communication device of claim 44, wherein:

said dielectric filter is used as a dielectric duplexer comprising a transmission filter and a reception filter.

58. The communication device of claim 45, wherein:

said dielectric filter is used as a dielectric duplexer comprising a transmission filter and a reception filter.

59. The communication device of claim 46, wherein:

said dielectric filter is used as a dielectric duplexer comprising a transmission filter and a reception filter.

60. The communication device of claim 47, wherein:

said dielectric filter is used as a dielectric duplexer comprising a transmission filter and a reception filter.

61. The communication device of claim 56, wherein:

said dielectric filter is used as a dielectric duplexer comprising a transmission filter and a reception filter.

62. The communication device of claim 44, wherein:

the balanced input-output portion of said dielectric filter and said balanced feed antenna are connected together on a line of a substrate.

63. The communication device of claim 45, wherein:

the balanced input-output portion of said dielectric filter and said balanced feed antenna are connected together on a line of a substrate.

64. The communication device of claim 46, wherein:

the balanced input-output portion of said dielectric filter and said balanced feed antenna are connected together on a line of a substrate.

65. The communication device of claim 47, wherein:

the balanced input-output portion of said dielectric filter and said balanced feed antenna are connected together on a line of a substrate.

66. The communication device of claim 56, wherein:

the balanced input-output portion of said dielectric filter and said balanced feed antenna are connected together on a line of a substrate.

67. The communication device of claim 44, wherein:

the balanced input-output portion of said dielectric filter and said balanced feed antenna are directly connected together by bonding said dielectric filter and said balanced feed antenna.

68. The communication device of claim 45, wherein:

the balanced input-output portion of said dielectric filter and said balanced feed antenna are directly connected together by bonding said dielectric filter and said balanced feed antenna.

69. The communication device of claim 46, wherein:

the balanced input-output portion of said dielectric filter and said balanced feed antenna are directly connected together by bonding said dielectric filter and said balanced feed antenna.

70. The communication device of claim 47, wherein:

the balanced input-output portion of said dielectric filter and said balanced feed antenna are directly connected together by bonding said dielectric filter and said balanced feed antenna.

71. The communication device of claim 56, wherein:

the balanced input-output portion of said dielectric filter and said balanced feed antenna are directly connected together by bonding said dielectric filter and said balanced feed antenna.

72. The communication device of claim 44, wherein:

said balanced feed antenna is constructed on a dielectric block in which a balanced feed terminal is formed on an outer surface thereof.

73. The communication device of claim 45, wherein:

said balanced feed antenna is constructed on a dielectric block in which a balanced feed terminal is formed on an outer surface thereof.

74. The communication device of claim 46, wherein:

said balanced feed antenna is constructed on a dielectric block in which a balanced feed terminal is formed on an outer surface thereof.

75. The communication device of claim 47, wherein:

said balanced feed antenna is constructed on a dielectric block in which a balanced feed terminal is formed on an outer surface thereof.

76. The communication device of claim 56, wherein:

said balanced feed antenna is constructed on a dielectric block in which a balanced feed terminal is formed on an outer surface thereof.

77. The communication device of claim 44, wherein:

said balanced feed antenna and said dielectric filter are formed integrally with a dielectric block.

78. The communication device of claim 45, wherein:

said balanced feed antenna and said dielectric filter are formed integrally with a dielectric block.

79. The communication device of claim 46, wherein:

said balanced feed antenna and said dielectric filter are formed integrally with a dielectric block.

80. The communication device of claim 47, wherein:

said balanced feed antenna and said dielectric filter are formed integrally with a dielectric block.

81. The communication device of claim 56, wherein:

said balanced feed antenna and said dielectric filter are formed integrally with a dielectric block.

82. The communication device of claim 77, wherein:

an effective permittivity of said dielectric block is different between a portion of said dielectric block comprising said balanced feed antenna and a portion of said dielectric block comprising said dielectric filter.

83. The communication device of claim 78, wherein:

an effective permittivity of said dielectric block is different between a portion of said dielectric block comprising said balanced feed antenna and a portion of said dielectric block comprising said dielectric filter.

84. The communication device of claim 79, wherein:

an effective permittivity of said dielectric block is different between a portion of said dielectric block comprising said balanced feed antenna and a portion of said dielectric block comprising said dielectric filter.

85. The communication device of claim 80, wherein:

an effective permittivity of said dielectric block is different between a portion of said dielectric block comprising said balanced feed antenna and a portion of said dielectric block comprising said dielectric filter.

86. The communication device of claim 81, wherein:

an effective permittivity of said dielectric block is different between a portion of said dielectric block comprising said balanced feed antenna and a portion of said dielectric block comprising said dielectric filter.

* * * * *